United States Patent [19]

Pressman et al.

[11] 4,006,983

[45] Feb. 8, 1977

[54] ELECTROSTATIC COLOR PRINTING SYSTEMS USING MODULATED ION STREAMS

[75] Inventors: Gerald L. Pressman, San Jose; Kenneth W. Gardiner, Odenthal-Hahnenberg, both of Calif.

[73] Assignee: Electroprint, Inc., Cupertino, Calif.

[22] Filed: Oct. 29, 1973

[21] Appl. No.: 410,743

[52] U.S. Cl. ..... 355/4; 355/3 R

[51] Int. Cl.[2] ..... G03G 15/01

[58] Field of Search ..... 355/3 R, 4, 16, 17; 96/1 R, 1.2, 1.3; 346/74 ES, 74 P

[56] References Cited

UNITED STATES PATENTS

| | | | |
|---|---|---|---|
| 2,990,278 | 6/1961 | Carlson | 355/3 TR |
| 3,506,347 | 4/1970 | Carlson | 355/3 R |
| 3,532,422 | 10/1970 | McFarlane | 355/4 |
| 3,645,614 | 2/1972 | McFarlane et al. | 355/3 R |
| 3,680,954 | 8/1972 | Frank | 355/3 R |
| 3,685,896 | 8/1972 | Kaupp | 355/3 TR |
| 3,697,164 | 10/1972 | Pressman et al. | 355/4 |
| 3,817,615 | 6/1974 | Adachi et al. | 355/3 TE |

*Primary Examiner*—R. L. Moses
*Attorney, Agent, or Firm*—Townsend and Townsend

[57] ABSTRACT

The invention basically comprises systems and methods relating to the field of electrostatics and is concerned with multicolor electrostatic reproduction, printing or constituting on coated and uncoated print receiving media with multilayer apertured elements or screens carrying charge distributions in accordance with selected color separation patterns. Ions accelerated through the apertures of the multilayer element pass therethrough under modulation control dictated by the color separation pattern, thereby forming a modulated ion stream having a cross-sectional density pattern corresponding to the color separation pattern. Electrostatic latent images are formed with modulated ion streams and are developed in various ways.

21 Claims, 33 Drawing Figures

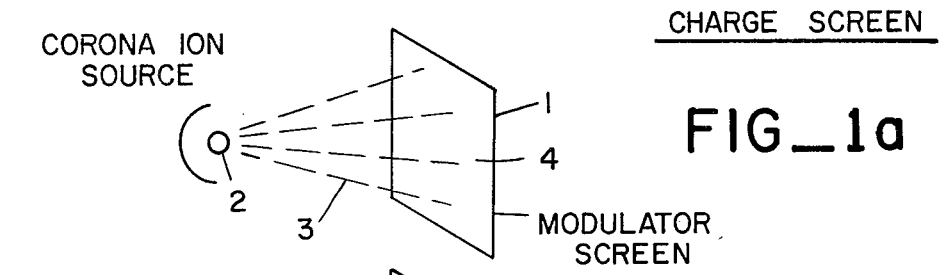
FIG_1a
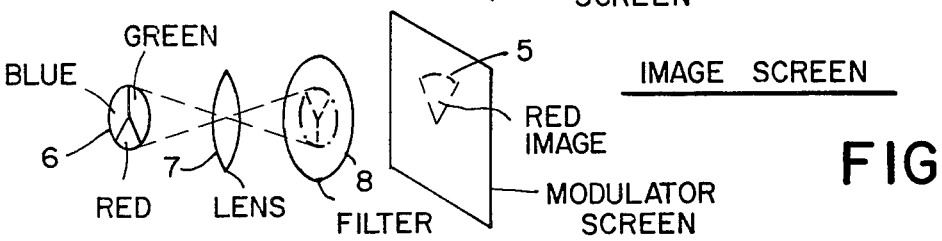
FIG_1b
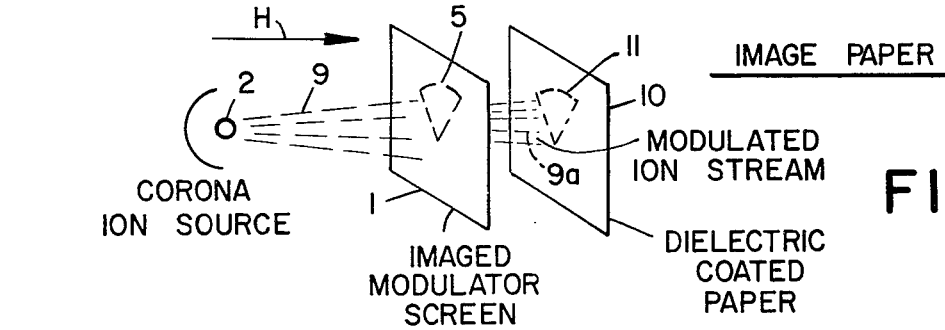
FIG_1c
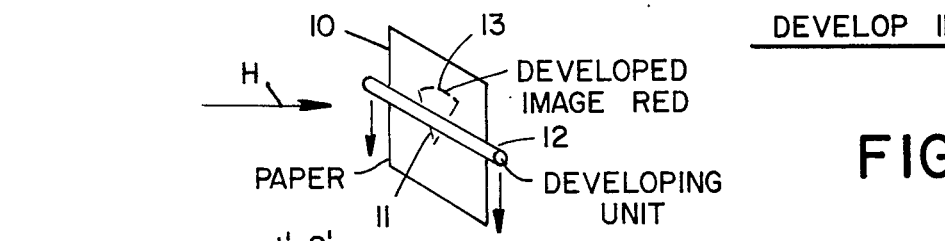
FIG_1d
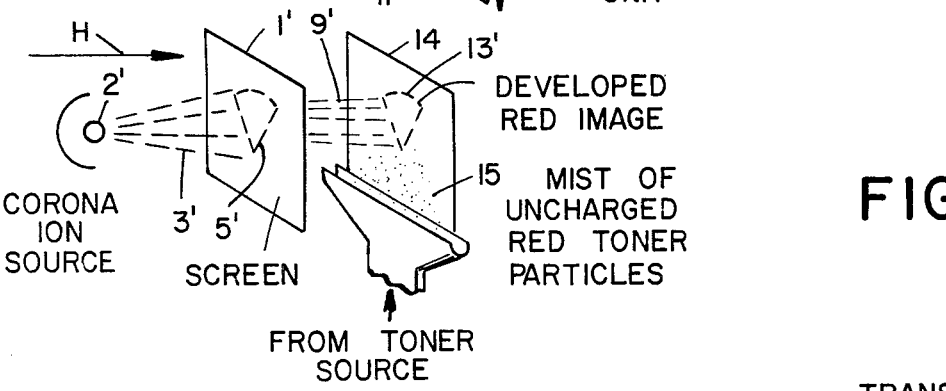
FIG_1c'
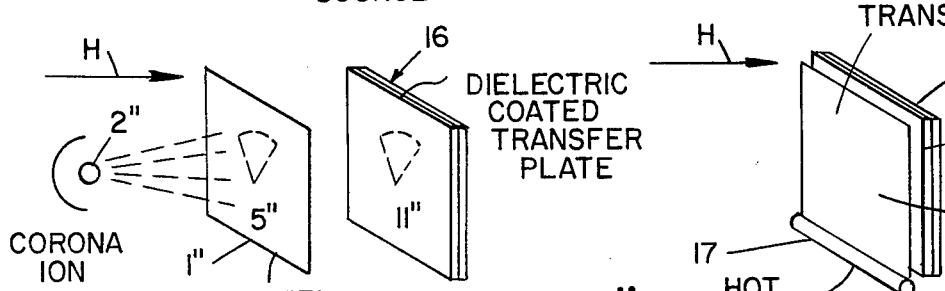
FIG_1c"
FIG_1d"

CHARGE SCREEN

IMAGE SCREEN

IMAGE PAPER

REMOVE PAPER

DEVELOP IMAGE

DEVELOP IMAGE

BLOT

ELECTROSTATIC COLOR PRINTING SYSTEMS USING MODULATED ION STREAMS

This invention relates to new and improved systems, methods and apparatus for electrostatic printing and, in particular, to an electrostatic printer or copier capable of producing high quality, full color prints on either dielectric-coated or uncoated paper, or on other media.

BACKGROUND OF THE INVENTION

The present invention constitutes an improvement over the inventions of both U.S. Pat. No. 3,532,422 issued Oct. 6, 1970 entitled "Method and Apparatus for Electrostatic Color Reproduction" by Samuel B. McFarlane, assignor to ElectroPrint, Inc., the assignees of the instant invention; and the co-pending commonly assigned application of Pressman and Kittredge U.S. Ser. No. 800,236 filed on Feb. 18, 1969 entitled "Method and Apparatus for Aperture Controlled Electrostatic Image Color Reproduction or Constitution." The prior art includes Kaprelian U.S. Pat. No. 2,986,466; Lusher U.S. Pat. No. 3,399,611; Frank U.S. Pat. No. 3,680,954; and Snelling U.S. Pat. No. 3,288,602.

McFarlane U.S. Pat. No. 3,532,422 relating to "Methods and Apparatus for Electrostatic Color Reproduction" employs latent electrostatic charged images formed on a photoconductive interrupted surface such as a grid or screen. The imaged screen is dusted with charged colored toner marking materials, thus developing the image but leaving it in an unfixed state on the screen, and then the developed toner image or pattern is projected by electrical field across an air gap onto a print receiving medium. In the preferred arrangement, multicolor printing is accomplished by uniformly charging the photoconductive surface and then optionally projecting a first primary color image thereupon. This image is then developed by powdering it in a first color and the powder pattern transferred substantially intact by electrical field across the air gap onto the paper or other material to be printed. Then the second and third primary color images are laid down in the same manner so that the resulting reproduction exhibits all the colors of the multicolor original. Fixing may occur between colors or at the end.

The assignee's pending U.S. application Ser. No. 800,236 is also concerned with multicolor electrostatic reproducing or constituting. Here again, an interrupted photoconductive surface, such as a screen, is employed to carry charge distribution in accordance with selected color separation patterns. In a preferred embodiment, tone particles directed at the screen pass therethrough under modulation control dictated by the charge pattern. The patterns are determined by separating the colors of the original into primary color components and those patterns are developed on the print receiving medium in sequence and registry with appropriately colored toners. The screen is multilayered and preferably comprises at least an insulative and conductive layer provided with an array of electrostatically sensitive apertures. An electrical propulsion field directs the charged toner particles through the screen to the print receiving medium which is preferably spaced at a distance from the screen. Charge distribution on the screen controls the flow of particles through the apertures, some of the apertures being in effect blocked, partially blocked, unblocked, or enhanced, depending on the local charge level. This occurs for each color separation and the toner patterns which result are applied in sequence on the print receiving medium to reconstitute the image in color.

BRIEF SUMMARY OF THE INVENTION

The present invention differs substantially from those described above in several important respects including that ions, rather than charged toner particles, are projected through the modulator apertured element or screen. The resulting modulated ion pattern is employed to create developed images in any one of several different ways. The use of ions in the particle flow, instead of toner marking material, avoids any problem of toner build up on the screen and permits the use of lower potentials for gating the particle stream. Moreover, it will be shown that the unique characteristics of the ion projection modulated aperture printing system, when employed in combination with certain controls, procedures and mechanisms, are especially well suited to provide high quality multicolor printing characterized by full range toner density control, high contrast and accurate color tone reproduction.

The basic steps employed in the practice of the present invention are as follows: A suitable multilayer apertured element or screen is covered with a substantially uniform electrostatic charge which is then selectively discharged by exposure to an optical pattern or image corresponding to one color separation of the original multicolor image to be reproduced. Appropriately charged ions are projected through the screen and modulated thereby to form a modulated ion stream whose cross-sectional density pattern corresponds to the charged pattern on the screen. The modulated ion stream pattern is then utilized in one of several ways to form a printed image of the first color separation. In one embodiment, the ion stream is projected toward the print receiving medium through a mist of uncharged toner particles. Toner particles which collide with the ions become charged and are accelerated by an electrostatic field onto the print receiving medium, which may be ordinary uncoated paper. The paper support is preferably conductive and is held at a predetermined potential relative to the ion source so that it forms one electrode establishing an ion and charged toner particle accelerating field. In another embodiment, the screen modulated ion stream is accelerated directly onto the dielectric surface of dielectric coated paper supported on a conducting plate or drum and the image developed by appropriate means. For example, the ion charged surface of the dielectric paper may be either powdered with charged dry toner particles or submerged in a liquid suspension of charged toner particles. Still other techniques utilizing the modulated ion stream may be employed and will be discussed later in detail. The above steps are repeated once for each color separation image, each of which is printed in registry with each other color separation image on the print receiving medium thereby reproducing the desired multicolored original. The variously colored images thus combine on the printed page to produce secondary and other colors as desired or as may be required to accurately reproduce the color tones of the original multicolor image. While it may be convenient or desirable to fix each color separation image as it is formed, normally, and particularly when fine toner particles are employed as in liquid toner suspensions, the fixing step may be delayed until all color toner images have been developed. When liquid toners are employed, it is most desirable to promptly remove any excess liquid from the surface of the print receiving medium as soon as the image is formed, such as by blotting or with an air knife or other appropriate means.

Various types of multilayer apertured elements will be suitable for use in the present invention, and several illustrative embodiments will be Various types later.

In the present invention, for accurate reproduction of full color original images, it is essential that the various color separation images be accurately extracted from the original, accurately translated into an electrostatic latent image on the screen, and faithfully developed on the print receiving medium. Moreover, it is preferable that all black areas on the original be reproduced by laying down corresponding patterns of black on the bare print receiving medium and maintaining the black printed surfaces thereof free of subsequent coloration when additional color separation images are printed. Futhermore, under present technology it is common for commercially available dyes to contain unwanted traces of other colors. For example, in the case of the three colors commonly used for full color printing, (cyan, magenta and yellow) the cyan colorant will have some magenta and yellow in it, the magenta colorant will have some yellow in it, and only the yellow colorant is normally free of additional unwanted tones. Known full color printing operations often employ the technique of "masking" to correct for these dry absorption errors. For example, when a magenta image is being printed over a cyan image which already has some magenta in it, less magenta is deposited on the cyan than in areas where no cyan has been printed.

The ion stream modulating color printing system of the present invention, generally as a result of the manner in which the electrostatic latent image is formed and the degree of full range density control which can be achieved, is particularly well suited for achieving the objectives and solving the problems discussed above so that accurate full color reproduction may be obtained.

Furthermore it will be seen that where, for accurate toner density control, the electrostatic modulated aperture copying system employed in the present invention requires the screen or other apertured element to be initially charged to a certain level, charging should be as uniform as possible across the entire printing area of the screen. Accordingly, the present invention is partially concerned with methods and apparatus for achieving a highly uniform pre-illumination charge distribution on the screen as will be described later in detail.

Moreover, it will be seen that when successive electrostatic color images are developed, one over the other, on a print receiving medium, development tends to be incomplete leaving undesirable residual charges which tend to adversely affect subsequent image development. The present invention discloses methods and apparatus for controlling and neutralizing residual charges resulting from incomplete development.

Further, the present invention discloses methods for accomplishing close control over color toner densities throughout the density spectrum, thus tending to assure that density or intensity reproduction will be consistent throughout the density range extending from the lightest or least dense areas to the darkest or most dense areas with a given color.

In addition, the present invention discloses methods and apparatus for achieving non-contact multicolor printing so that multicolor reproduction on irregular surfaces may be attained.

It is thus the principal objective of the present invention to provide methods and apparatus for fast and accurate full color reproduction of multicolor originals. It is another objective of the present invention to provide a non-contact system for multicolor electrostatic reproduction and printing.

It is still another objective of the present invention to provide a full color aperture electrostatic printing system.

A further objective of the present invention is to provide a full color electrostatic printing or copying system which is well suited for high contrast black area printing.

Still another objective of the present invention is to provide a full color electrostatic printing or copying system which is particularly well suited for correction of dye absorption errors by masking techniques.

Still another objective of the present invention is to provide techniques and apparatus for highly uniform pre-illumination charging of the screen so that accurate reproduction of image densities throughout the original image may be obtained.

Yet another objective of the present invention is to provide accurate multicolor reproduction through close control of toner deposit densities throughout the density spectrum.

Further objectives include eliminating inter-image effects by neutralizing residual charges from incompletely developed image areas.

These and other objects and advantages of the foregoing invention will be better understood from a reading of the following detailed description when taken in conjunction with the drawings wherein:

BRIEF DESCRIPTION OF THE DRAWINGS

FIGS. 1*a* through 1*d* are schematic illustrations of the processing steps for reproducing a single color separation image from a multicolor original on dielectric coated paper;

FIG. 1*c'* is a schematic illustration of an alternate image developing step in the process illustrated in FIGS. 1*a* through 1*d* wherein a mist of uncharged toner particles is charged by a modulated ion stream and the image printed on ordinary paper;

FIG. 1*c''* and 1*d''* are schematic illustrations of alternate image developing steps in the process illustrated in FIGS. 1*a* through 1*d* wherein a single color separation image is developed on a dielectric coated transfer plate and transferred to ordinary paper by hot rolling the opposite side of a sheet of ordinary paper laid over the developed image on the transfer plate;

MODULATED APERTURE PRINTING

Figure 2:
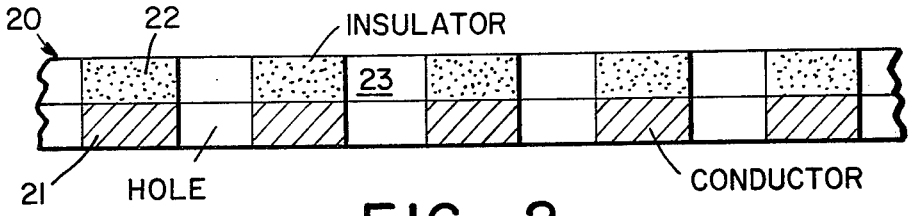
FIG. 2 is a sectional view of one embodiment of the multilayer apertured element of the present invention.

The basic system of electrostatic printing employed in the present invention, sometimes referred to herein as modulated aperture electrostatic printing, copying or reproduction, is common to all embodiments of the present invention and is generally set forth in the following commonly assigned U.S. Pat. No. 3,625,604 by Gerald L. Pressman entitled "Aperture Controlled Electrostatic Printing System." This disclosure describes a multilayer apertured element or screen including at least a conductive layer and an adjacent insulative layer on which an electrostatic latent image is formed for modulating a flow of charged toner particles, ions or other printing particles projected through the apertures of the screen by an electrical accelerating field. A double layer of charge is established on opposite sides of the insulative layer for selectively producing overlapping lines of force or "fringing fields" within the apertures. These fringing fields can be selectively modified across the face of the screen to substantially completely block the passage of charged particles through certain apertures, to enhance and accelerate the passage of charged particles through other apertures, and to control the width and density of the particle stream through other apertures over a continuous spectrum. A stream or flow of charged particles projected through the screen by an overall applied field is therefore modulated to provide a cross-sectional density pattern substantially corresponding to the image or pattern to be reproduced. Several variations in screen design can be employed as described later. In construction of the screens, the ratio of insulator thickness to aperture diameter (the "T/D ratio") is sufficiently small so that the fringing field in a fully blocked or enhanced aperture does not extend more than a few screen thicknesses away from the aperture.

PREFERRED EMBODIMENTS

FIGS. 1*a* through 1*d* illustrate basic steps of the present invention in a dielectric coated paper modulated aperture printing process. In FIG. 1*a* a multilayer apertured element 1 herein sometimes referred to as a "modulator screen" charged with ions from a corona ion source 2. The multilayer apertured element or modulator screen 1 consists of at least two layers one of which is electrically conductive and the other of which is photoconductive. Ions 3 from the corona ion source are projected onto the exposed surface of the photoconductive layer 4 and held there by equal and opposite charges drawn into the conductor from ground or the like. FIG. 1*b* shows a single color separation image 5 formed on the modulator screen 1 from a multicolor original pattern 6 to be reproduced. The multicolor original 6 consists of red, blue and yellow areas and is formed through a lens 7 and projected through a red transmission filter onto the uniformly charged photoconductive surface of the modulator screen 1, thus forming a single color separation image 5 (a red image) which selectively discharges the photoconductive layer in the illuminated areas. In FIG. 1*c*, a stream of ions 9 from the corona ion source is accelerated by electrostatic field H towards a dielectrically coated sheet of paper 10. The ion stream 9 passes through the imaged modulator screen 1 and impinges on the paper 10 with a modulated cross-sectional density 9*a* corresponding to the pattern 5 on the modulator screen 1. The modulated ion pattern 9*a* is held on the paper 10 by electrostatic field H to form an undeveloped electrostatic latent color separation image 11.

In FIG. 1*d* according to the present invention, the undeveloped electrostatic latent image 11 appearing on the paper 10 is developed with a suitable developing unit 12 which applies appropriately colored toner particles to the charged face of the dielectric coated paper, thus developing a single color toned image 13 on the paper 10. The above steps are repeated for each of the other colors employing differently colored filters and toners. Fixing may follow each development step or it may be deferred until all three colors have been applied. When liquid suspension toners are employed, the developed image is preferably immediately blotted or otherwise processed to remove any excess fluid following each developing step, since images developed with liquid toner have a tendency to migrate.

In FIG. 1*c'* according to the present invention, a second basic alternative is shown which does away with the need for dielectric paper. Dielectric coated paper is normally required for electrostatic latent images formed upon the paper itself since paper is somewhat conductive and the charge images tend to dissipate by conduction along the surface of the paper. Dielectric coated paper is employed to reduce the surface conductivity of the print receiving medium to acceptable levels; however, the requirements of many users make it highly preferable that printing be accomplished on uncoated paper. The present invention accomplishes this objective by substituting the steps shown in FIG. 1c' of the drawings for that shown in 1c. Rather than establishing an undeveloped electrostatic latent image on coated paper, uncoated paper 14 is used and a mist of uncharged appropriately colored toner particles 15 is introduced into the modulated ion stream, and toner particles colliding with the modulated ion stream 9a' passing through the modulator screen 1' become charged and are accelerated by the field H onto the paper 14 surface, thus forming a developed single color image 13'. As in previous embodiments the developed image 13' is either fixed or excess fluid removed and then the foregoing steps (screen charging, screen imaging, and image developing) are repeated for the other two colors to be printed. Fixing may be done after each color is developed, or it may be delayed until the entire multicolor image is developed.

A third basic alternative is illustrated in FIGS. 1c'' and 1d'' where an ion stream 3'' is projected under the influence of an electrostatic field H through an imaged screen 1'' onto a dielectric coated transfer plate 16 so that an undeveloped electrostatic latent image 11'' is formed upon the dielectric coating of the transfer plate 16. The image 11'' is then developed either by powdering it with dry toner or by using liquid developer. A sheet of uncoated paper 14'' is thenpressed over the image and the image transferred to the paper either by electrostatic attraction or by heat, for example, as is shown in FIG. 1d'' wherein a hot roller 17 presses the paper 14'' against the image 11'' on the plate 16. Normally the dielectric coated transfer plate 16 has a biased conductive backing service as one electrode forming the electrostatic field H.

Color Separation and Color Toning

The general principles of reproducing multicolored images with color separations and subsequent color toning are common to all of the embodiments discussed herein. In normal instances, either three or four colors will be used. In a three color additive positive printing system, for example, the three primary colors, red, blue and yellow, are employed. In a comparable four color system, black is added. Printing with an apertured element or screen produces a half tone effect and, just as half tone printing in black and white paper gives the observer the visual effect of the various gradations of tone present in the original, the colored half tone effect of the present invention gives the illusion that a wide range of colors is present. Each single color image is printed in dots with transparent ink and, as the three of four color separation images are printed one upon the other, the dots fall along one side another and overlap. These dot combinations form many more many than the original three or four. In forming color separation images, the original multicolor object of pattern to be reproduced is transformed into an optical image by any one of numerous optical techniques well known in the art. For example, the original multicolor pattern may be transmitted to the screen by opaque or transparent projection means, via a focusing lens. A filter is positioned in the path of the optical projection, preferably over the lens or immediately ahead or behind it. The filter allows only light rays of a particular color to pass. Standard process filters suitable for use in the system of the present invention are Wratten filters A25 (red), B58 (green) and C5-47 (blue). A red separation image produced by filtering the original through the A25 red filter will have high illumination in the areas containing a high red content and low illumination or darkness in the areas containing little or no red content. Accordingly the photoconductive layer on the screen will be relatively conductive in areas corresponding to a high red content and the photoconductor will be relatively non-conductive in imaged areas having little or no red content. Thus for positive printing, the print receiving medium should be developed with high densities of red color toner in the highly illuminated areas and little or no red toner in the low illumination areas. Alternatively the preferably a positive print may also be produced in a subtractive color process by printing the areas corresponding to low illumination with minus-red. This is a bluish-green color called "cyan". Low illumination areas from the green filter can be printed or developed in minus-green which is bluish-red or "magenta". Low illumination levels from the blue filter are printed with minus-blue or yellow. When three developed images are laid one upon the other in exact alignment or registry, the original multicolor pattern will be accurately reproduced. Accordingly, in the preferred embodiment, the polarity of the ion stream relative to the various areas of the multilayer apertured screen will be selected so as to provide blocking fields in the areas of high illumination and either neutral fringing fields or, preferably, enhancing fields in areas of low illumination.

It may be desirable to use one or more colors in addition to the three primary or primary equivalent colors discussed above. For example, in cases where metallic effects are wanted, colors such as bronze, gold or silver may be added. Additional colors or combinations of colors may also be added to produce desired tints. Conventional four-color printing, where black is the fourth color, can also be accomplished and a special process for this purpose is discussed in greater detail elsewhere herein.

The toner dyes employed in the present invention are preferably transparent and may be laid down in any order convenient to the process, with the exception that the most opaque material is usually deposited first. It is understood that while, in the foregoing and subsequent portions of the description, there are shown various embodiments of the present invention which will be discussed in terms of three color printing, the present invention is not limited to the use of only three colors and contemplates alternate embodiments employing four color printing, metallic tone printing, tints or the like as discussed herein or as will be apparent to the artisan of ordinary skill.

Multilayer Apertured Elements

Figure 3:
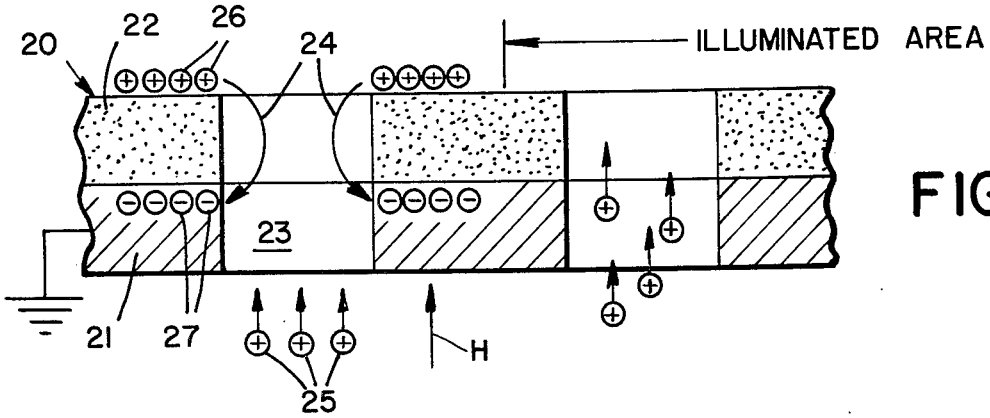
FIG. 3 is an enlarged view of a portion of the apertured element shown in FIG. 2 after an electrostatic latent image has been formed upon it.

Numerous suitable multilayer apertured elements may be employed as the modulator of the present invention. One elementary form of multilayer apertured element is illustrated in FIG. 2 and is a screen 20 comprised of an apertured conductor layer 21 overlaid with an apertured insulator layer 22. The apertures 23 in said layers being in registry and extending from the front to back face of the element. FIG. 3 illustrates in schematic form how a bipolar double layer electrostatic charge forms on the insulator layer 22 in the situation where, for example, the insulator layer is photoconductive. The charges 26 on the upper surface of the photoconductive layer 22 are positive, having been deposited there from a corona ion source, and the negative charges 27 beneath that layer have been attracted in equivalent numbers from ground through the conductor to locations opposite the upper ion charge layer. Electrostatic lines of force 24 from this double layer charge fringe into the apertures 23 and, in the case of positive ions 25 tending to be accelerated through the apertures 23 by electrostatic field H, the fringing fields 24 act to repel or block passage of the ions 25. Inasmuch as the positive and negative charges 26 and 27 in the double layer charge are in close proximity and each layer paired with an oppositely charged layer of equal magnitude, force fields resulting from such layers consist of lines of force 24 which are effectively tied together in a very short span so that they have only short range effectiveness, being essentially limited to a single aperture. In portions of the screen where the photoconductive surface is illuminated causing the photoconductive layer to become electrically conductive, oppositely charged particles are attracted to one another through the photoconductor and combine to dissipate the double layer charge as illustrated at the right hand side of the screen 20 in FIG. 3, so that in an area where high illumination of the photoconductor has resulted in the photoconductor becoming highly conductive, it is theoretically possible for all of the charge layers to be dissipated whereupon the apertured element will offer no electrostatic resistance to the passage of ions. In the screen 20 of FIG. 3, ion-open apertures correspond to printing and ion-blocked apertures correspond to non-printing. Thus, the illustration of FIG. 3 shows a negative printing system where the heaviest ion densities formed in the modulated ion stream correspond to the areas of highest illumination. The apertured element of FIG. 3 may be employed, in combination with special charging techniques, to effect positive printing. A thorough discussion of this and other aspects of the operation of elementary double layer charge apertured elements for modulating charged toner particle streams may be found in commonly assigned Pressman U.S. Pat. No. 3,625,604 entitled "Aperture Controlled Electrostatic Printing System", and many of the principles, techniques, and screen designs shown there are appropriate for utilization in the present modulated ion stream multicolor printing system as will be apparent to persons of ordinary skill in the present art.

Figures 4A, 4B, 4C, 4D, 4E:
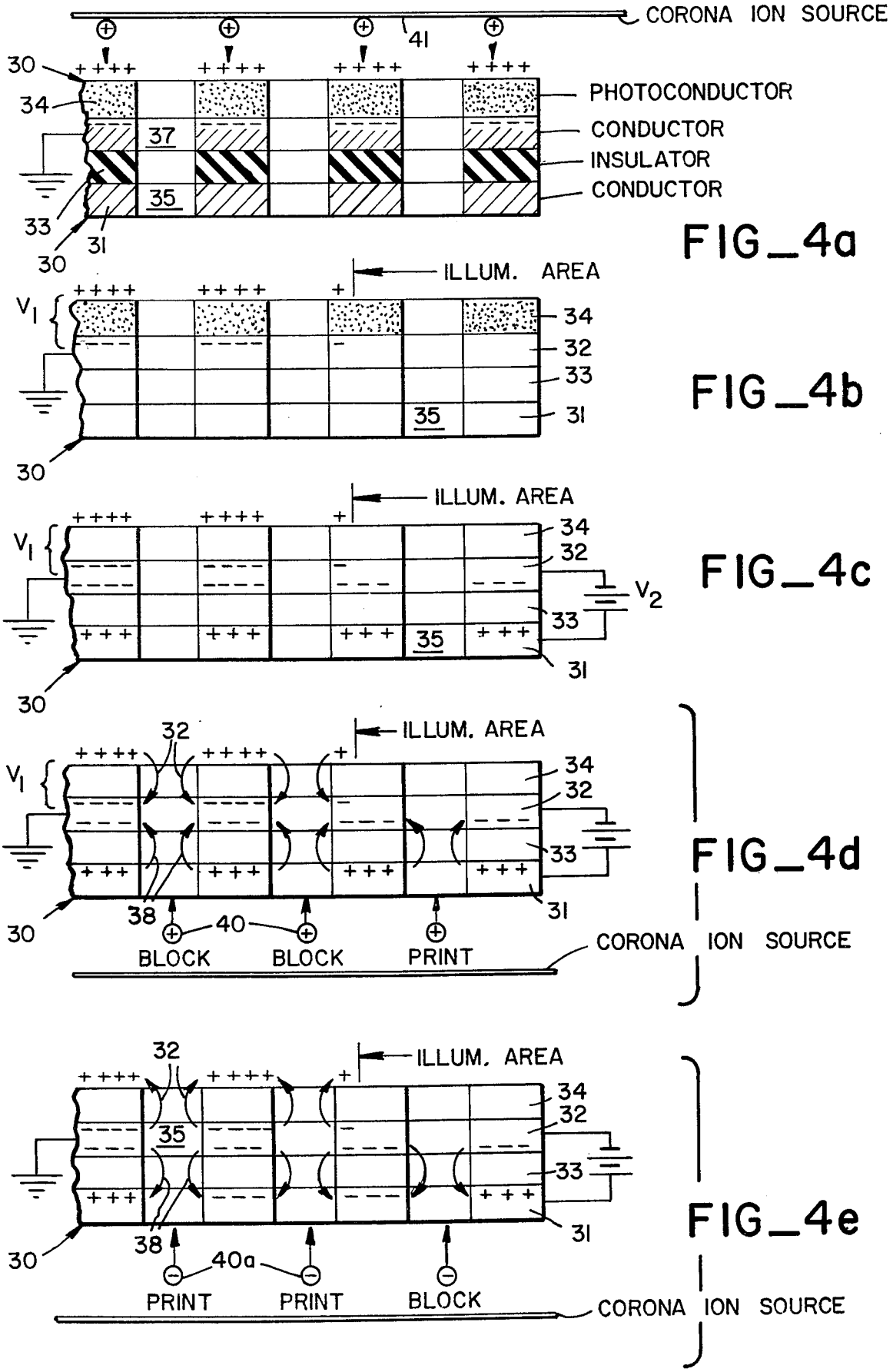
FIGS. 4*a* through 4*c* are enlarged views of a preferred four-layer apertured element, shown during the steps undertaken in imaging the element and modulating the ion stream therewith.

The multilayer apertured element of the present invention may be a four layer element constructed along the lines of the four layer element 30 illustrated schematically in FIGS. 4*a* through 4*e* herein. FIG. 4*a* shows a multilayer apertured element 30 having first 31 and second 32 conductive layers with insulative layers 33 and 34 alternating with the conductive layers 31 and 32. In the preferred embodiment shown in FIGS. 4*a*–4*e*, the exposed insulator layer 34 is of a photoconductive material superposed on the surface of the second conductive layer 32 opposite the insulative layer. An array of apertures 35 extends transversely through all layers. One method for operating this screen is to first deposit a substantially uniform charge layer 36 across the outer surface of the photoconductive layer 34. A corona ion source 41 may be employed for this purpose. As shown in FIG. 4*a*, oppositely polarized charges 37 are drawn in substantially equivalent quantities from ground through the second conductive layer 32 to regions in the conductor opposite the charges 36 residing on the upper surface of the photoconductor 34. FIG. 4*b* illustrates how illumination of a portion of the photoconductive layer dissipates the double layer charge in that region so that the double layer charge across the photoconductive layer varies directly in accordance with the pattern of illumination applied. The potential difference across the photoconductor at any particular point is generally referred to in FIGS. 4*a* through 4*e* and $V_1$. A second voltage is applied across the insulator layer as shown in FIG. 4*c* and that voltage is represented here generally by the symbol $V_2$. FIG. 4*d* of the drawings illustrates how the imaged four layer screen appears to positive ions tending to be accelerated through the screen by electrostatic field H in both illuminated and non-illuminated areas. The double layer bipolar charge formed across the first insulator (the applied voltage $V_2$) results in fringing fields 38 in the apertures whose polarity is oriented to assist, enhance or accelerate the flow of positive ions 40 therethrough. Fields oriented in a direction tending to assist the flow of ions through the aperture are hereinafter sometimes referred to as "enhancing fields". In non-illuminated regions of the screen, bipolar double layer charge $V_1$ remains at a high level with the polarity of its fringing fields 39 oriented in a direction tending to block the flow of positive ions 40 through the apertures. Such fields are hereinafter sometimes referred to as "blocking fields". $V_1$ is greater in magnitude and opposite in polarity from $V_2$ so that fringing force fields 38 and 39 produce a resultant field tending to block passage of positively charged ions 40 through apertures 35 in the non-illuminated areas.

"Gray scale" reproduction by variation in printing particle densities may be accomplished since variations in the intensity level of illumination results in proportional variations in the magnitude of $V_1$ so that the resultant field $V_1$ minus $V_2$ may be wholly blocking, partially blocking, neutral, partially enhancing, or enhancing throughout a continuous spectrum of illumination levels and fringing field forces.

The screen illustrated in FIG. 4*d* is conditioned for negative printing with positive ions since the highest density ion transmission appears in the areas of highest illumination. FIG. 4*e* illustrates how the same screen may be employed for positive printing by simply changing the polarity of the transmitted ions. Thus the bipolar double layer charge distributions which provide blocking forces for the positive ions provide enhancing forces for the negative ions, in which case ion image densities will be greatest in the areas of lowest illumination.

Changing the polarity of the ion stream is easily accomplished by simply changing the polarity of the corona wire.

Additional details in the structure and operation of the foregoing four layer apertured modulator element are set forth in commonly assigned co-pending U.S. Pat. application Ser. No. 197,877 by Crane, Pressman and Eilers, now U.S. Pat. No. 3,713,734. The four layer screen has several advantages for the modulated ion stream color printing system of the present invention. One important advantage is that it can be constructed, charged, imaged and controlled to produce printing densities which vary in direct substantially linear proportion to the quantity of illumination projected onto the photoconductive layer. However, in order to meet these objectives, it is essential that certain conditions be met. The present invention discloses novel methods and apparatus for meeting these conditions and accomplishing the foregoing objectives, specifically including the procedures hereinafter referred to as "back-side charging" and "multi-level aperture biasing."

Figure 16:
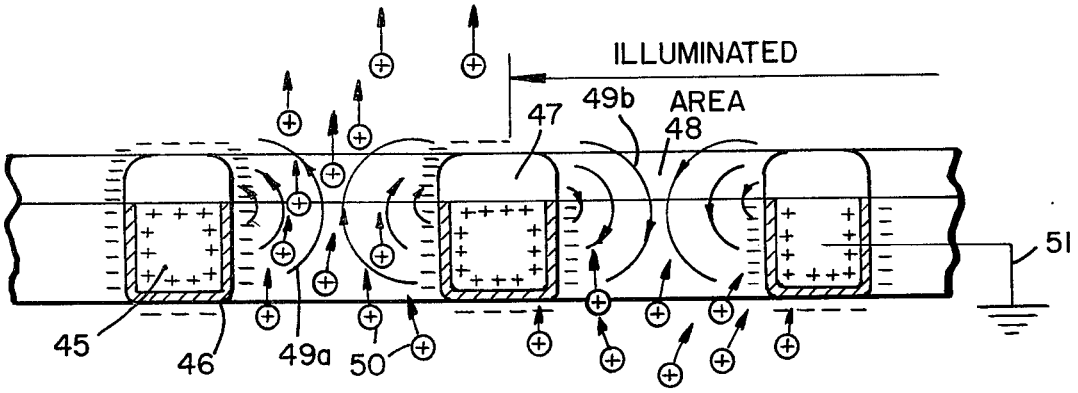
FIG. 16 is a schematic representation, in section, of one multilayer apertured element suitable for use in the present invention where all portions of the conductive core or layer are covered with insulating material, either photoconductive or otherwise.

In an alternate embodiment of multilayer apertured element or modulator, (described in greater detail in commonly assigned U.S. Pat. No. 3,694,200 of Pressman) for use in the present invention, the electrostatic screen modulator 44 comprises a conductive apertured screen 45 having insulating materials 46 and 47 coated on all sides thereof and on the inner surfaces defining the screen apertures 48. In the embodiment illustrated by FIG. 16, the upper insulator is a layer of photoconductive material 47. The photoconductive insulative material 47 is coated to a greater thickness than the insulative material coated on the inner surface of the apertures and on the other side of the screen 44 so that greater potential can initially be established on the side of the screen coated with the photoconductive material by charging from a single ion source. With the conductive screen core or layer 45 connected to a fixed potential such as ground 51, a light image is projected on the photoconductive side of the screen thereby to selectively dissipate the initially uniform charge distribution in proportion to the intensity of the incident light. The result is a bipolar electrostatic latent image of overlapping or fringing force fields 49*a* and 49*b* in the apertures of the screen for modulating the flow of printing ions 50 directed through the screen. The arrangement of the electrostatic screen modulator permits enhancing lines of force 49*a* or no lines of force to be established within the apertures corresponding to the dark portions of a projected pattern to be reproduced. At the same time blocking lines of force 49*b* of variable strength are established within the apertures of the screen corresponding to regions of variable light intensity of the projected pattern to be reproduced. The resultant feature and advantage is that direct positive electrostatic printing is obtained with modulation of a stream of ions by means of an apertured element or screen supporting a bipolar electrostatic latent image. In all embodiments, the ratio of the thickness of the field generating layer to the diameter of the aperture should be selected so that the field fringing into an aperture does not extend more than a few screen thicknesses beyond the aperture. As a general rule, this ratio should be less than about 1.

Back-side Charging

Figure 5A:
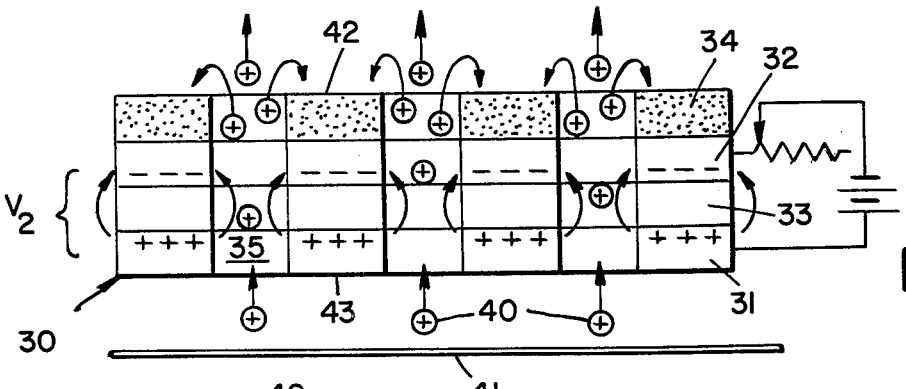
FIGS. 5*a* through 5*c* shown an enlarged four-layer apertured element undergoing pre-illumination charging according to the so-called "back-side charging" process.
Figure 5B:
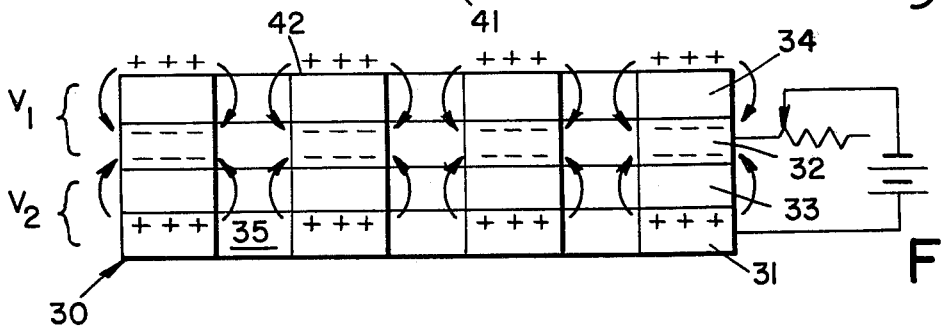
Figure 5C:
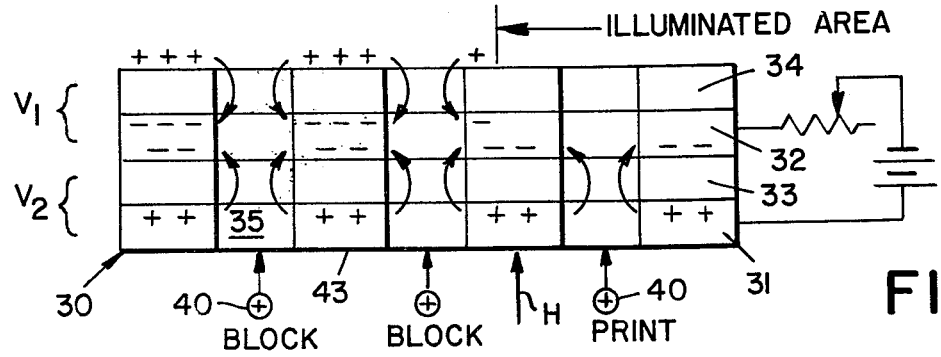

For high quality multicolor reproduction, it is important that pre-illumination charging of the screen, i.e. the charge applied to the photoconductive layer prior to imaging, be as uniform as possible. The present invention teaches novel techniques and systems for accomplishing this objective. The screen 30 employed is preferably of the four layer variety shown in FIG. 4 of the drawings. According to the novel techniques and systems of the present invention, a voltage $V_2$ is first applied across the insulator layer 33 of the screen 30 forming a bipolar double layer charge as shown in FIG 5*a*. For insulator biasing $V_2$ having polarity as shown in FIG. 5*a*, i.e. with negative charge formed on the insulator surface facing away from the ion source 41, positive ions are introduced into the apertures 35 from a corona ion source 41 located at the back-side 43 of the screen (i.e. from the side adjacent the first conductor layer 31). $V_2$ acts as an enhancing field, thereby projecting the positive ions 40 through the apertures 35 to the opposite or photoconductive side of the screen. Encountering no further accelerating forces, the ions 40 tend to deposit upon the photoconductive surface. Since, as shown in FIG. 5*b*, ions deposited on the face or "front side" 42 of the photoconductive surface tend to attract equal and opposite charges from ground through the second conductive layer 32 to the backside of the photoconductive layer, a second bipolar double layer charge $V_1$ forms across the photoconductor 34 which is opposite in polarity to $V_2$ and tends to resist the flow of additional positive ions through the apertures. Once sufficient charge has accumulated on the front side 42 of the photoconductive layer 34 to cause $V_1$ to equal or slightly exceed $V_2$, then no further ions will pass through the apertures 35 from the back-side 43 of the screen 30 and charging of the photoconductor will cease. Any further ions entering the apertures will be diverted to the second conductor layer, and conducted away without further effect upon the screen. Accordingly, it is seen that the voltage $V_2$ applied across the insulator layer places an upper limit on the quantity of charge that can be applied to the photoconductive layer from the back-side 43 of the screen 30. If back-side charging is allowed to proceed for a long enough period of time, eventually all zones of the photoconductive layer adjacent the apertures will be charged to uniform levels equal to or slightly exceeding the bias voltage $V_2$. In this context, it is understood, that when back-side charging is spoken of as providing "uniform" photoconductive layer charging, the word uniform employed in this context is not necessarily limited to exact uniformity. In back-side charging, charges tend to build up on the photoconductor in uniform patterns symmetrically arranged about the center line of each aperture. However, this is the effective equivalent of a uniform charge, since each aperture will be associated with a charge pattern of similar density and symmetrical configuration and incident ions will therefore "see" the screen charge as being virtually uniform across its entire surface. Accordingly, if the light responsive properties of the photoconductor are homogeneous throughout, a given level of illumination applied to the photoconductive surface of the screen will leave a predictable quantity of charge on the photoconductor in those areas so illuminated, thus providing an electrostatic latent image on the screen which is consistent in all areas of the screen and wholly satisfactory for accurate high quality multicolor reproduction. In addition, back-side charging also often allows the same ion source to be employed for both pre-illumination charging and for establishing the modulated ion stream. As shown in FIG. 5*c*, once pre-illumination charging by the back-side method has been completed, the conductor bias $V_2$ is reduced to a lower potential ($V_2'$) to ready it for ion stream modulation, since at the high level ($V_2$), conductor bias would be too large relative to the photoconductor bias ($V_1$) thereby adversely affecting the blocking ability of the screen. For positive additive printing, an ion stream having the same polarity as the charge layer in the second conductor layer 32 (in FIG. 5*c*, these are positive ions) is accelerated by electric field H through the apertures to modify the cross-sectional density of the stream in accordance with the electrostatic latent image on the screen. For positive subtractive printing, the polarity of ions employed is opposite that of the charge in the second conductive layer.

Figure 6A:
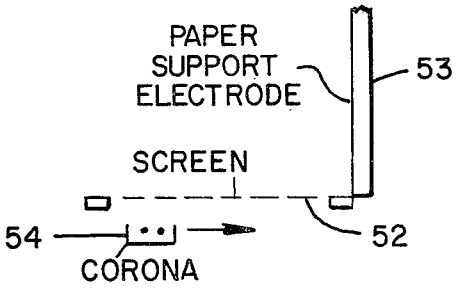
FIGS. 6*a* through 6*f* illustrate the steps and apparatus employed in a simple planar multicolor reproduction process according to the present invention.
Figure 6B:
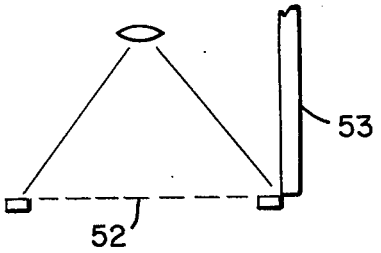
Figure 6C:
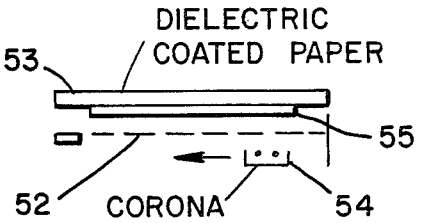
Figure 6D:
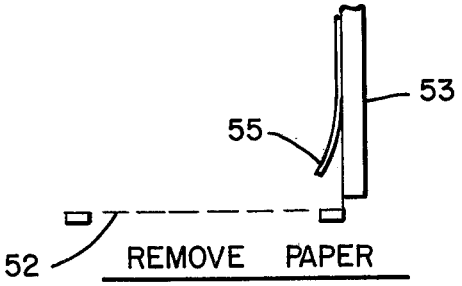
Figure 6E:
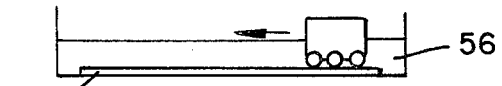
Figure 6D:
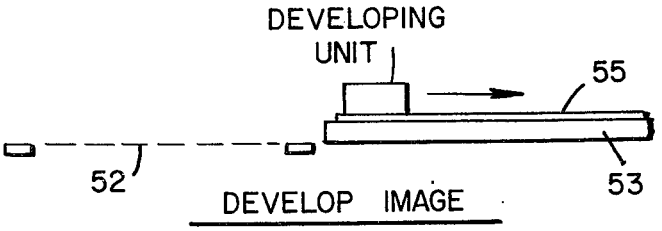
Figure 6F:
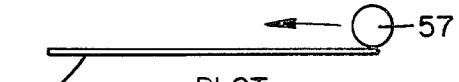

Referring now to the multicolor reproduction system of the present invention illustrated in FIGS. 6*a* through 6f there is provided a suitable multilayer apertured screen 52 as described hereinabove. A paper support electrode 53 is mounted at one edge of said screen for hinged movement between a first or rest position spaced from the screen as shown in FIG. 6*a* and a second or paper imaging position adjacent and parallel to the screen as shown in FIG. 6*c*. With the paper support electrode in its rest position, a corona ion source 54 is employed to charge the screen, which is preferably of the four layer type illustrated in FIGS. 5 and 6 so that back-side charging may be employed. Next, a single color separation from a multicolor pattern to be reproduced is projected onto the photoconductive surface of the screen thereby forming an electrostatic latent image corresponding to the color separation. A sheet of dielectric coated paper 55 is positioned on the paper support electrode and the electrode moved to its second or imaging position parallel to the screen and opposite the corona. The corona which was first employed to charge the screen is now employed to scan the back-side of the screen and generate ions which are attracted through the screen to the paper by the paper support electrode which is biased for ion attraction. The paper is then developed and this may be accomplished in any one of several ways. As shown in FIG. 6*d* the paper support electrode may be removed to its first position, and then the paper lifted off and developed in a liquid toner solution 56 as shown in FIG. 6*e*. Alternatively, the paper may be developed while it is still on the paper support electrode as shown in FIG. 6*d'*. Various other developing techniques described herein may also be employed. Where liquid toners have been used, it is generally advisable to employ a blotter roller 57 or other means to remove any excess fluid from a developed image prior to subsequent imaging steps as shown in FIG. 6*f*. If the paper is removed from the paper support electrode it is returned in registry with its former position and the process repeated for second and third color separation images. After all three color separation images have been developed on the paper, the multicolor image is then fixed. In the alternative, as in most of the other systems described herein, it may be convenient to fix each color separation image immediately after it is developed, although this is not required.

Figure 7:
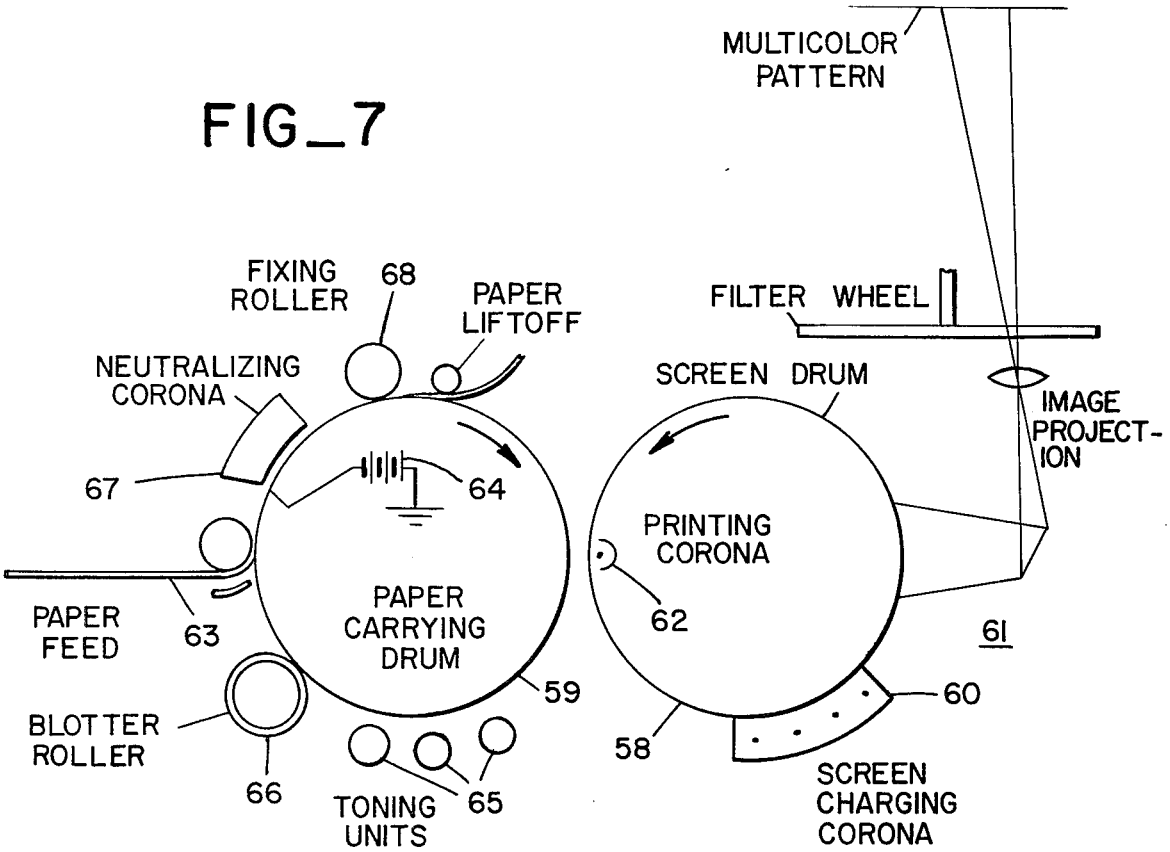
FIG. 7 is a schematic illustration of a rotary drum automatic multicolor printing system according to the present invention.
Figure 8:
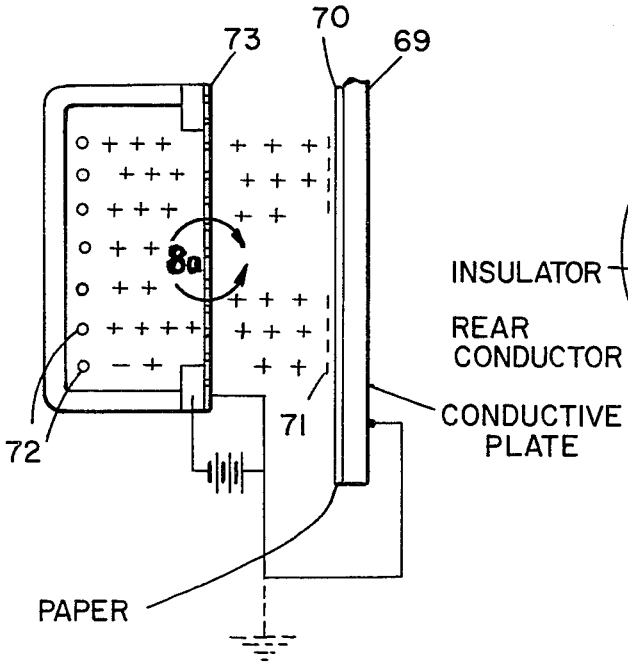
FIG. 8 is a sectional elevation of a neutralizing corona system according to the present invention.

FIG. 7 illustrates a system suited for automatic electrostatic color reproduction wherein the multilayer apertured element is a screen shaped to form a cylinder or a drum 58 with the photoconductive layer facing radially outwardly. The screen drum rotates counterclockwise in registry and synchronism with a paper carrying drum 59 which has an identical diameter and rotational velocity and rotates in a clockwise direction. A corona 60 is provided at a screen station adjacent to the exterior surface of the screen drum. Ions from this corona are employed to uniformly charge the surface of the photoconductive screen layer. Spaced counterclockwise from the screen charging station is an imaging station 61 where the image from a multicolored pattern to be reproduced is color-filtered and focused upon the exterior surface of the screen drum subsequent to charging. A second corona, referred to in FIG. 7 as the printing corona 62, is located at a printing station which is spaced 180° from the imaging station. The printing corona is located at the interior surface of the screen drum adjacent its most proximate point to the paper carrying drum. The paper carrying drum is conductive and carries dielectric coated paper 63 on its exterior surface. When the paper is carried into position adjacent the screen drum, the printing corona is activated and ions therefrom are accelerated through the imaged screen drum onto the paper surface, being held there by an ion attracting potential applied to the paper carrying drum, for example, as with battery 64. The paper carrying drum rotates to carry the imaged paper past toning units 65 at a toning station where a first toning unit is activated to apply an appropriately colored liquid toner to develop the image. The image is then blotted with blotter roller 66 to remove excess liquid and passed under a neutralizing corona. A neutralizing corona 67 is used to remove unwanted excess charges remaining after incomplete development of the image. Incomplete development is a common problem since the remaining undesired charges tend to interact with subsequent electrostatic latent images to produce unwanted interimage effects. A specific novel neutralizing corona structure is shown in FIG. 8 and will be discussed in detail below. After neutralization, the drum carried the paper under a fixing roller 68 which may be activated or not, as is convenient. The drums continue to rotate and all steps are repeated for the second color separation image and again for the third. If the fixing did not occur between images, it is done following development of the last image. The foregoing system may also be employed with dry toner in which case the blotter step is eliminated. While the foregoing has been shown and described in terms of a three color operation, it is understood here and in other embodiments that additional colors may be applied by adding one or more toning units.

Neutralization of Incompletely Developed Images

Figure 8A:
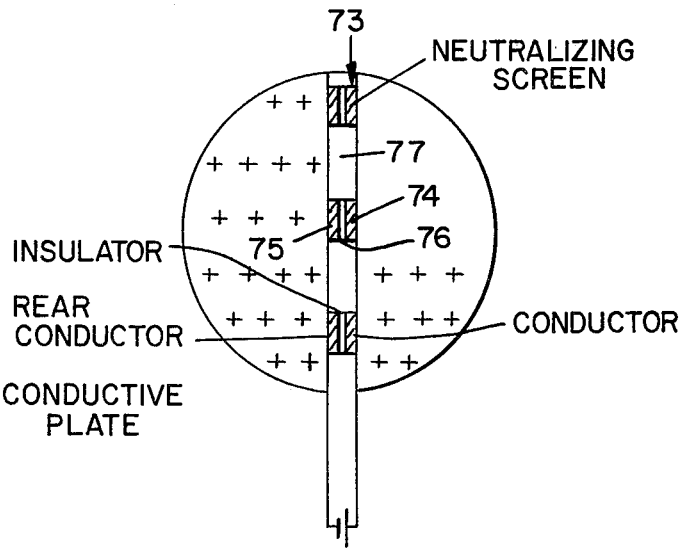
FIG. 8*a* is an enlarged view of the neutralizing screen of the system shown in FIG. 8.

FIGS. 8 and 8*a* illustrate novel methods and apparatus for neutralizing incompletely developed images. In conventional color printing operations the word "trapping" refers to the ability of a surface to accept ink in areas where other colors of ink have already been deposited. Normally this happens if too much time elapses from the first plate printing to the last since the ink from the first printing becomes dry and glazed and other colors do not adhere or trap. In electrostatic color printing, undesired trapping can be a result of incomplete development. For example, when the first color image is developed, not all of the charges in the latent image attract toner particles, leaving some fraction of the image undeveloped. If these undeveloped charges are allowed to remain, this area may attract some of the second and third colors causing poor quality reproduction and desaturation of colors. Thus, when incomplete development occurs, the dielectric surface is preferably neutralized before the next charge image is deposited. While some high quality liquid toners are capable of completely developing a charge image, most dry powders leave a large residual charge after development. The neutralizing technique of the present invention contemplates forming and accelerating an ion stream towards the developed electrostatic latent image on the dielectric. The ion stream is opposite in polarity to the undeveloped portions of the developed electrostatic latent image and the field accelerating the ions towards the paper is provided almost entirely by the undeveloped charge on the paper. Referring to FIG. 8 there is shown a conductive paper support electrode 69 (which could correspond to a rotary paper carrying drum as shown, for example, in FIG. 7). Dielectric coated paper 70 bearing an incompletely developed electrostatic latent image is carried by the paper support electrode and undeveloped portions of the image represented by negative charges 71 on the exposed paper surface. A corona ion source 72 floods the area with positive ions and a special multilayer neutralizing screen 73 comprised of front and rear conductive layers 74 and 75, respectively, interposed by an insulating layer 76 is positioned in the path between the corona ion source and the paper. The front and rear conductor surfaces of the screen are biased to provide small fringing fields in the apertures 77 which tend to accelerate the positive ions 78 from the ion source through the screen apertures in a direction towards the paper. The conductive paper support electrode is held at substantially the same potential as the adjacent conductor layer of the screen so that ions passing through the screen apertures will be attracted to the paper substantially only by the undeveloped negative charge residue remaining on the paper. Once the negative charge residue on the paper has been neutralized no attractive force remains and the paper is now ready to receive the next image. Ions in the area which exceed the number required for neutralization will tend to be conducted out of the neutralizing area by the oppositely polarized front conductive surface of the neutralizing screen.

Figure 9A:
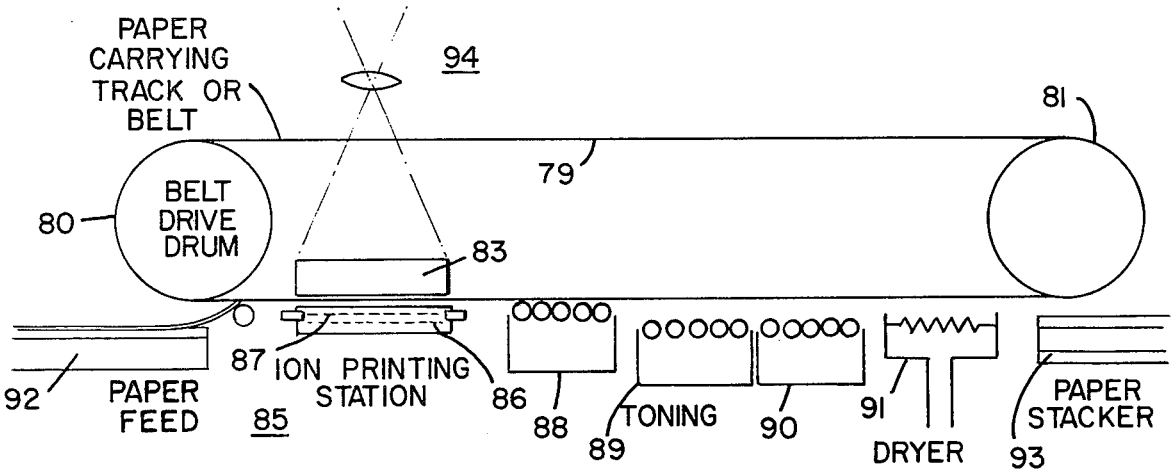
FIGS. 9*a* through 9*b'* are schematic illustrations of variations in a multicolor reproduction system suited for multiple copies according to the present invention.
Figure 9B:
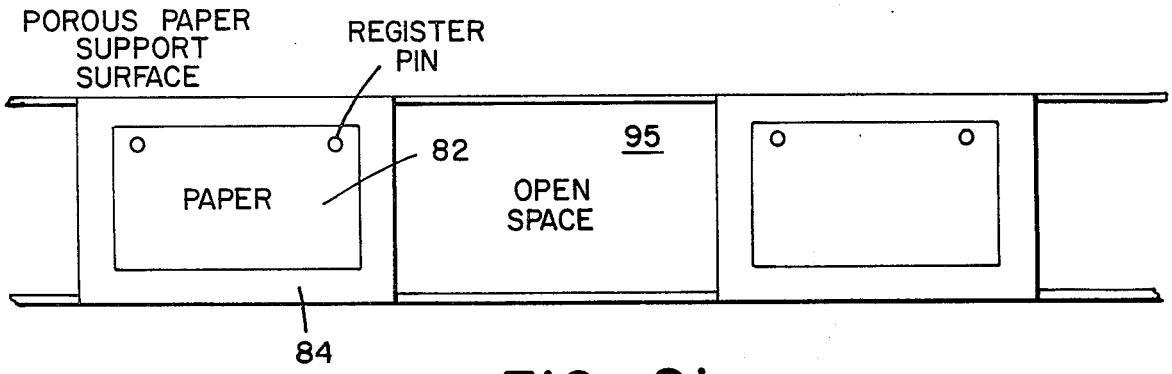
Figure 9B:
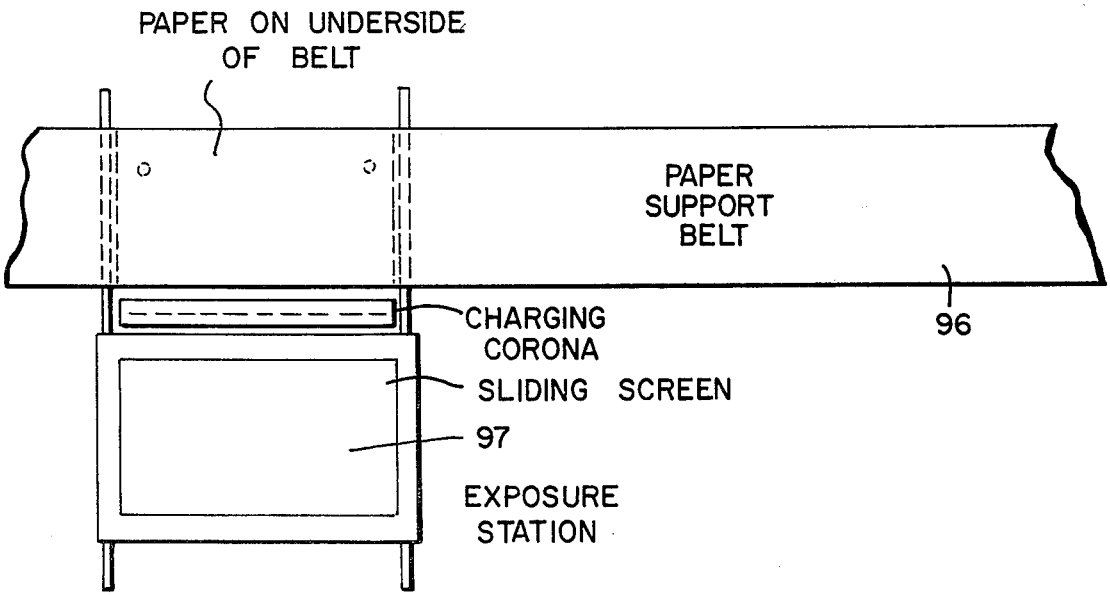

An electrostatic multicolor printing system for multiple copies is illustrated in FIGS. 9*a* through 9*b*'. In this regard it will be appreciated that the printing system illustrated in FIG. 7, for example, is wholly satisfactory for producing multiple copies except that screen imaging must be repeated for each copy. In the embodiment illustrated in FIGS. 9*a* through 9*b*', a single screen image is employed repeatedly to reproduce multiple copies of single color separation all at once. The single separation copies are then run through the machine a second time to print second color separation images in registry with the first images and the process repeated one or more times as required to develop the desired multicolored reproduction. Thus, in accordance with this aspect of the present invention, there is shown in FIG. 9*a* an endless paper carrying track or belt 79 supported between two rotary drums, 80 and 81, one of which 80 serves to drive the belt in rotation. Paper 82 is fed from a stack 92 at the left end of the system onto the lower surface of the lower span of the paper carrying track. Since this paper must briefly carry an electrostatic image it is normally dielectric coated. In any event, it has a preferred surface capacitance in excess of about $10^{-12}$ farads per square centimeter. The paper is pin registered on the paper support surface and held against the surface by a vacuum chamber 83 located on the opposite side of the paper support surface 84. The paper support surface is porous so that the vacuum attracts the paper through the paper support surface. An ion printing station 85 is positioned beneath the lower surface of the lower span of the paper carrying belt and comprises a corona ion source 86 and a multilayer apertured element 87 positioned between the ion source and the paper support surface. First, second and third toning units 88, 89 and 90 are positioned downstream from the ion printing station. Each unit supplies a single color and may be actuated separately from other units. Additional toning units may be employed where more than three toner colors are required. Suitable fixing means 91, such as a dryer, are positioned downstream from the toning unit and a paper stacker 93 is located at the downstream end of the track beyond the influence of the paper holding vacuum chamber. Back-side charging is employed to uniformly charge the apertured element prior to imaging and the same corona array is employed for both screen charging and imaging. The screen is preferably of the four layer variety illustrated in FIGS. 5 and 6. Appropriate color separation and projection apparatus is located at an imaging station 94 opposite the upper surface of the lower span of the paper carrying belt. As shown in FIG. 9*b*, porous paper support members are alternatively positioned along the paper carrying belt leaving open spaces 95 between so that the screen may be imaged by projection through these open spaces in the belt. In an alternate embodiment illustrated in FIG. 9*b*' a continuous paper support belt 96 is provided and the screen 97 is mounted for lateral sliding movement so that it clears the belt for imaging. While the above described system requires that the paper be pin registered for accurate registry of subsequent color image printing (unlike the system shown in FIG. 7), high through-puts are possible since simultaneous full area ion projection can be employed and more than one print can be in the developer section at one time. It will be appreciated that while numerous copies may be imaged and developed from a single screen imaging, this will be limited by the ability of the screen to retain a latent electrostatic image for a given period of time and through repeated use. This in turn depends upon several factors including the surface capacitance of the photoconductive layer employed in the screen and the extent to which it is possible to carry out the process in a light-tight environment. Accordingly, to the extent that the quality of the electrostatic latent image formed on the multilayer apertured screen deteriorates during a single color multiple copy printing operation, it may be necessary to reimage the screen from time to time.

Electrostatic Masking

Figure 10A:
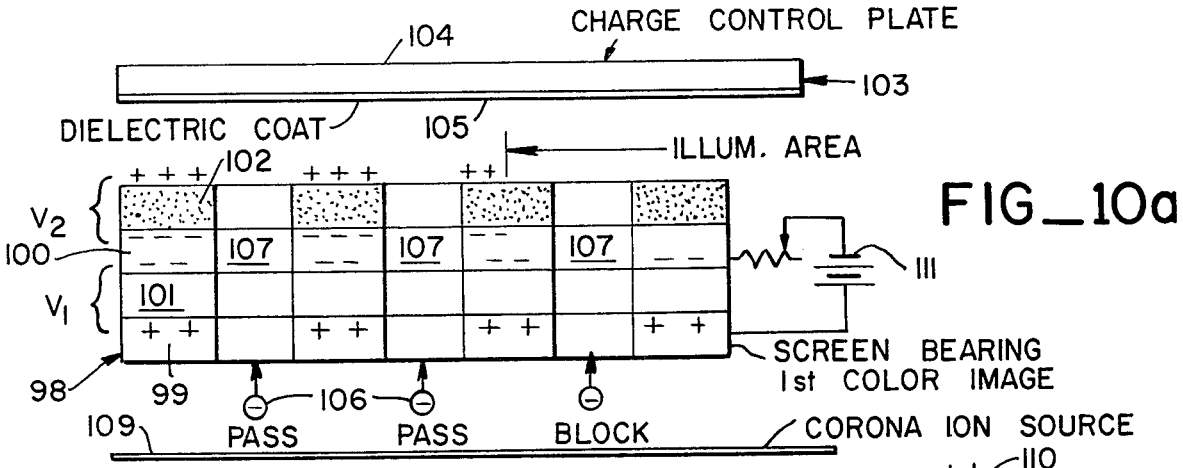
FIG. 10*a* illustrates a system for correcting for dye absorption errors according to the present invention.
Figure 10B:
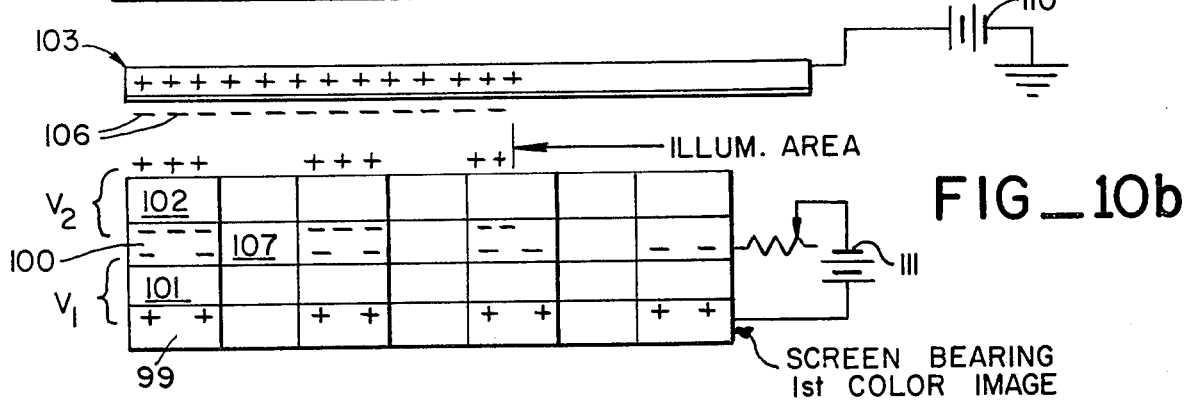
Figure 10C:
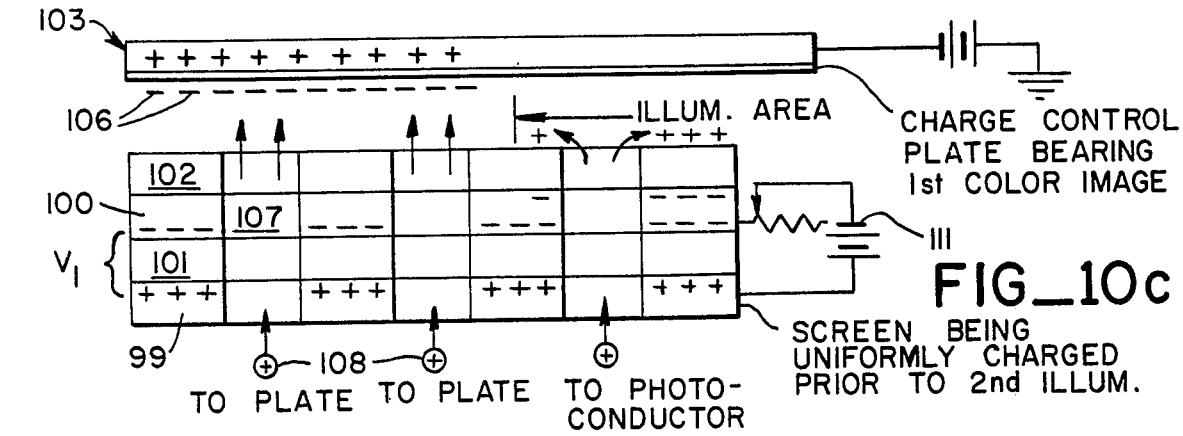

FIGS. 10*a* through 10*c* illustrate novel methods and systems apparatus according to the present invention for correcting colorant absorption errors. Absorption errors result from technical deficiencies in dye or pigments employed in printing operations and as a result are common to electrostatic color printing operations as well as traditional photographic color printing techniques. The problem arises in that while a high level of fidelity to the original may be obtained in color separation using color filters as described, no pigments, dyes or printing inks can reproduce those separation images accurately. The toner for development of a given color separation image should be the color which corresponds to or is complementary to the filter used so that each toner should reflect or absorb only one-third of the color spectrum. Unfortunately, toner colors cannot presently be manufactured which will give ideal results in the printed image. For example, cyan normally contains some magenta and yellow, while magenta normally contains traces of yellow, and only yellow is usually acceptably pure. Color correction masking is a technique employed in traditional color printing operations to correct for absorption errors. A mask is a photographic image superimposed over another photographic image to alter its transmission characteristics. Masks may be used to change the color contrast or to change the color balance of the original. As will be apparent from the following description, the modulated ion printing system is particularly well suited for correction of dye or pigment absorption errors by means of unique, specially devised electrostatic masking techniques according to the present invention.

According to the present invention, FIG. 10*a* illustrates a four layered apertured modulating element or screen 98 comprised of first and second conducting layers 99 and 100, respectively, interposed with an insulating layer 101. A photoconductive layer 102 is superposed on the second conductor layer and, as shown, the screen has been charged and imaged to carry an electrostatic latent image corresponding to a first single color separation image (the "Illuminated Area" corresponding to transmitted portions of a filtered optical image). A charge control plate 103 is positioned a short distance away from and parallel to the front side of the modulating element (i.e. the side carrying the photoconductor layer) and comprises a conductive backing 104 with dielectric coating 105 facing the photoconductive layer. The conductive layers 99 and 100 are biased with voltage $V_1$ tending to block the passage of negative ions 106 from an ion source 109 through the apertures 107 from the back-side to front side. The photoconductive layer is biased by suitable means 111 with a voltage $V_2$ in the nonilluminated areas. At its greatest value (i.e. in completely dark areas) $V_2$ is larger than $V_1$ and is opposite in polarity and tends to facilitate the passage of negative ions 106 through the apertures 107 from the side opposite the charging plate 103. In such areas the resultant electrostatic field of $V_2$ and $V_1$ will be an enhancing field to negative ions. The conductive layer of the charge control plate is held at a potential by suitable means 110 tending to attract negative ions so that negative ions from the corona ion source passing through the screen apertures in unblocked areas (i.e. in a non-illuminated or low illuminated area) will pass through the screen and be deposited on the charging plate in a pattern corresponding to the electrostatic latent image on the screen, as shown in FIG. 10*b*. So prepared, the charge control plate is utilized in a unique manner during charging the screen prior to imaging with the second color separation. As shown in FIG. 10*c* the screen is charged with positive ions 108 in a back-side charging operation while the imaged charge control plate is positioned a short distance from and parallel to the photoconductive layer of the screen. As is customary in back-side charging operations, the voltage bias across the conductive layers is maintained at a higher level ($V_1'$) during screen charging than during printing ($V_1$). Positive ions 108 from a corona ion source pass through the screen apertures from back to front and are deposited on the photoconductive layer in quantities forming a potential equal to or slightly exceeding $V_1'$ in areas adjacent uncharged areas of the charge control plate, positive ions passing through the apertures will be attracted to the negative polarity image 106 on the charging plate in quantities sufficient to neutralize that image so that, in those areas, the number of positively charged ions deposited on the screen is reduced. Accordingly, the screen is charged in a manner so that negative ions passing through the screen after imaging with the second color separation will pass through in lower densities in areas corresponding to the dark or low illumination areas of the first image. Accordingly, in a subtractive coloration process where, for example, the first image is developed in cyan which is contaminated with traces of magenta, the second or magenta image will be developed in lower densities in regions previously printed in cyan, thus avoiding an overall excessive magenta content in cyan printed areas. Where, as is common, the first and second developed images each contain contamination of the third developed color, the charging plate may be imaged with both the first and second electrostatic image and used in the described manner for printing of the third image. In a negative to positive reproduction process, the charge control plate would be charged the same in non-illuminated areas as in the process illustrated, but the polarity of the printing ions (i.e. the ions projected into the liquid toner mist, or onto dielectric coated paper or onto a transfer drum) would be reversed. Accordingly, the end result of using a charge control plate would be to cause lighter printing in more heavily illuminated areas of the first image.

The charge control plate may also be used in the multicolor reproduction system of the present invention where it is desired to print black in addition to the other three colors. A black printing step is commonly employed in traditional multicolor printing operations if the printer desires to add detail and contrast as to the printed reproduction. In the process of the present invention, a black separation image is formed according to the same general procedure used for other separation images. The preferred filter for this separation is a "split filter" which is a combination of all three of the previous filters, one at a time, with exposure for each running from 50–100% of that used for each filter on the individual separations. The object is to eliminate all but the major dark lines and shadows in the finished image since a heavy black printing plate would interfere with clean clear printing of the other colors. The black image is preferably developed first and subsequent images are thereafter preferably formed to avoid printing on the previously black printed areas and this is accomplished, according to the present invention, with the charge control plate discussed above. First the charged modulator screen is imaged with a black separation and then the black image printed with relatively high contrast. Printing may be on dielectric paper or uncoated paper according to techniques previously discussed. Next, ions are projected through the black separation screen image to form an undeveloped electrostatic latent image on the dielectric surface of the charge control plate. This image is formed with ions of opposite polarity of the ions employed in printing. The image on the charge control plate is made with high contrast, i.e. with high density ion deposits, so that the imaged charge control plate has a relatively high potential in the areas corresponding to black printing. The black-imaged charge control plate is then used in each successive screen charging step for successive color separation images. By setting the black-imaged charge control plate at a sufficiently high potential, it is possible to assure that no subsequently printed colors will be printed over darkest of the previously printed black areas.

Figure 11:
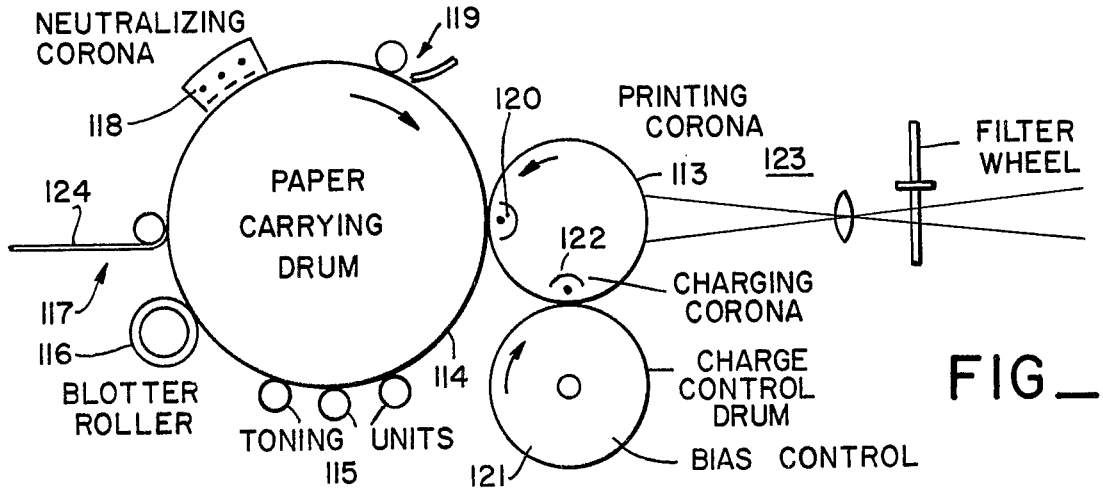
FIG. 11 is a schematic representation of a rotary drum multicolor printing system employing a charge control drum for correcting dye absorption errors according to the present invention.

According to the present invention, a rotary drum electrostatic multicolor reproduction system incorporating a charge control plate for correcting colorant absorption errors and/or for use in black printing is shown in FIGS. 11 and comprises a cylindrical drum-like multilayer apertured printing screen 113 suitable for back-side charging. The screen is preferably the four layer screen construction shown in FIGS. 4 and 5. The screen drum is mounted for rotation in a counter-clockwise direction adjacent a cylindrical paper carrying drum 114 constructed of a conductive material and having a diameter which is twice that of the screen drum. The paper carrying drum is mounted for rotation in a clockwise direction and an appropriate number of toning units 115 are positioned at the external surface of the paper carrying drum immediately clockwise of the screen drum. A blotter roller 116, paper feed mechanism 117, neutralizing corona 118, and paper lift-off means are respectively spaced in a clockwise direction at locations around the external circumferential surface of the paper carrying drum. An ion imaging or printing corona 120 is positioned inside the screen drum at its closest point to the paper carrying drum and faces in that direction. A charge control drum 121 is mounted for rotation in a clockwise direction immediately adjacent the external surface of the screen drum at a point approximately 90° counterclockwise from the printing corona. The charge control drum consists of a conductive cylindrical layer covered on its radially outer surface with a dielectric substance. Means for controlling the bias of the conductive porton of the charge control drum are provided and a charging corona 122 is located inside the screen drum at its closest point to the charge control drum and facing the charge control drum. An imaging station 123 comprised of means for forming color separations and projecting the same on the screen drum is provided at a position suitable to project images on the screen drum approximately 180° from the printing corona.

According to the present invention in a three color printing operation performed with the apparatus of FIG. 11, the charging corona 122 is activated to apply a uniform charge to the photoconductive layer on the radially outer surface of the screen drum 113 utilizing back-side charging techniques as described hereinabove. The uniformly charged surface of the screen drum rotates in a counterclockwise direction to the imaging station 123 where a first color separation image is projected thereupon to form an electrostatic latent image on the screen drum corresponding to the first color separation image. The screen drum rotates 180° counterclockwise until its imaged portion is adjacent to the printing corona 120 whereupon the latter is activated to project suitably charged ions through the screen drum onto dielectric coated paper 124 carried on the external surface of the paper carrying drum. The imaged paper on the paper carrying drum is then carried clockwise to the developing units 115 where one of the units is activated and liquid toner applied. As the paper continues to be carried in a clockwise direction by the paper carrying drum, it passes beneath a blotter roller 116 which removes excess liquid and then beneath the neutralizing corona 118 which neutralizes undeveloped portions of the electrostatic image formed on the paper. The screen drum 113 and the paper carrying drum 114 are positioned in registry and their movements synchronized so that the paper carrying drum completes one revolution for every two revolutions of the screen drum. Thus, during the time that the paper completes one revolution on the paper carrying drum, beginning from the time when it is printed at the screen and ending at the time when it returns to the screen drum for receiving the second color separation image, the screen drum and charge control drum each complete two revolutions. During the first screen drum revolution it is charged and imaged as described and the image transferred by the charging corona to the charge control drum, also as described. During the second screen drum revolution, the screen drum is again charged but this time in proximity with the first electrostatic latent image on the charge control drum thereby modifying the otherwise uniform charging of the screen in accordance with the first electrostatic latent image for black printing or dye absorption error control. The thus-charged screen drum is then imaged and in position for ion-printing the second corrected electrostatic latent image on the paper at the end of its second revolution. The foregoing steps are repeated in the same sequence until all three color images have been developed. A fourth toning unit (not shown) is required for black printing and all other steps are carried out sequentially as for three color printing, except that screen control-layer bias V and ion projection current are adjusted during the black printing step to produce higher contrast.

Figure 12:
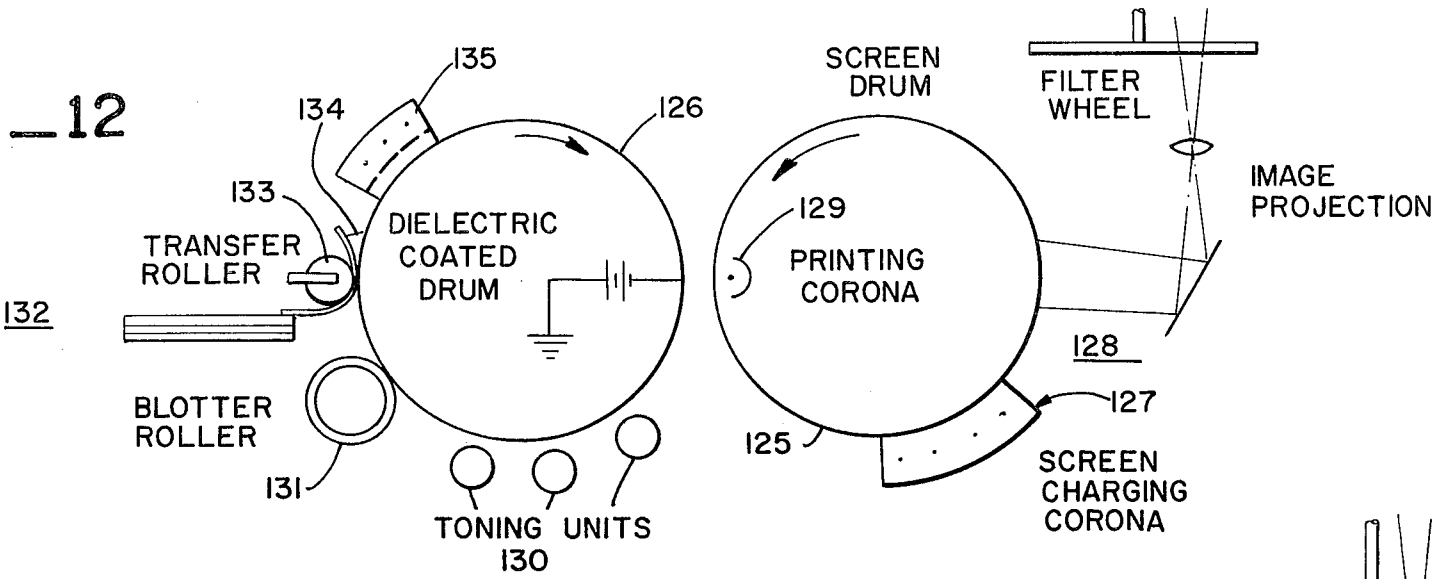
FIG. 12 is a schematic representation of a multicolor rotary drum printing system according to the present invention for printing on uncoated paper with a dielectric coated transfer drum.

A multicolor system according to the present invention for printing on uncoated paper is illustrated in FIG. 12 and includes a standard cylindrical multilayer screen drum 125, and a dielectric coated transfer drum 126. The screen drum and transfer drum are equal in diameter and mounted for rotation about parallel axes in synchronism and register, the screen drum rotating in a counterclockwise directon and the dielectric coated drum rotating in a clockwise direction. A screen charging corona 127 is mounted at the radially outer surface of the screen drum immediately clockwise of an imaging station 128 and a printing corona 129 is located inside the screen drum at the point closest to the dielectric transfer drum, approximately 180° from the imaging station. Three toning units 130 are located at the exterior surface of the transfer drum immediately clockwise of its closest point to the screen drum. Excess liquid removing means such as a blotter roller 131, air knife, or warm air blower are located immediately clockwise of the toning units. A paper feed mechanism 132 is located at the external surface of the transfer drum immediately clockwise of the excess liquid removing apparatus and a heated transfer roller 133 is provided at the paper feed followed in the clockwise direction by a paper removing mechanism 134 and a neutralizing corona 135. According to the present invention, the screen drum is charged by the screen charging corona and then imaged with a first color separation image at the imaging station. When the imaged screen is rotated to a point adjacent the dielectric coated transfer drum the printing corona is actuated to project printing ions through the screen onto the dielectric coated transfer drum and form an undeveloped electrostatic latent image thereupon. The undeveloped image is carried in a clockwise direction to the first toning unit where appropriately colored toner is applied to develop the image and any excess liquid immediately removed. The foregoing steps are repeated in sequence so that at the end of three revolutions the dielectric surface of the transfer drum carries a fully developed multicolor image. Following the third blotting step in the three color printing operation, the paper is fed onto the transfer drum to overlay the developed image and compressed against the developed image by the heated roller so that toner particles are transferred from the drum and fixed to the paper forming the developed multicolor image. The foregoing system of transferring a developed electrostatic latent image from a transfer surface to a print receiving medium is disclosed in detail in co-pending commonly assigned U.S. patent application Ser. No. 219,616 of David E. Blake, filed Jan. 21, 1972 entitled "Contact Transfer Electrostatic Printing System and Method."

Figure 13:
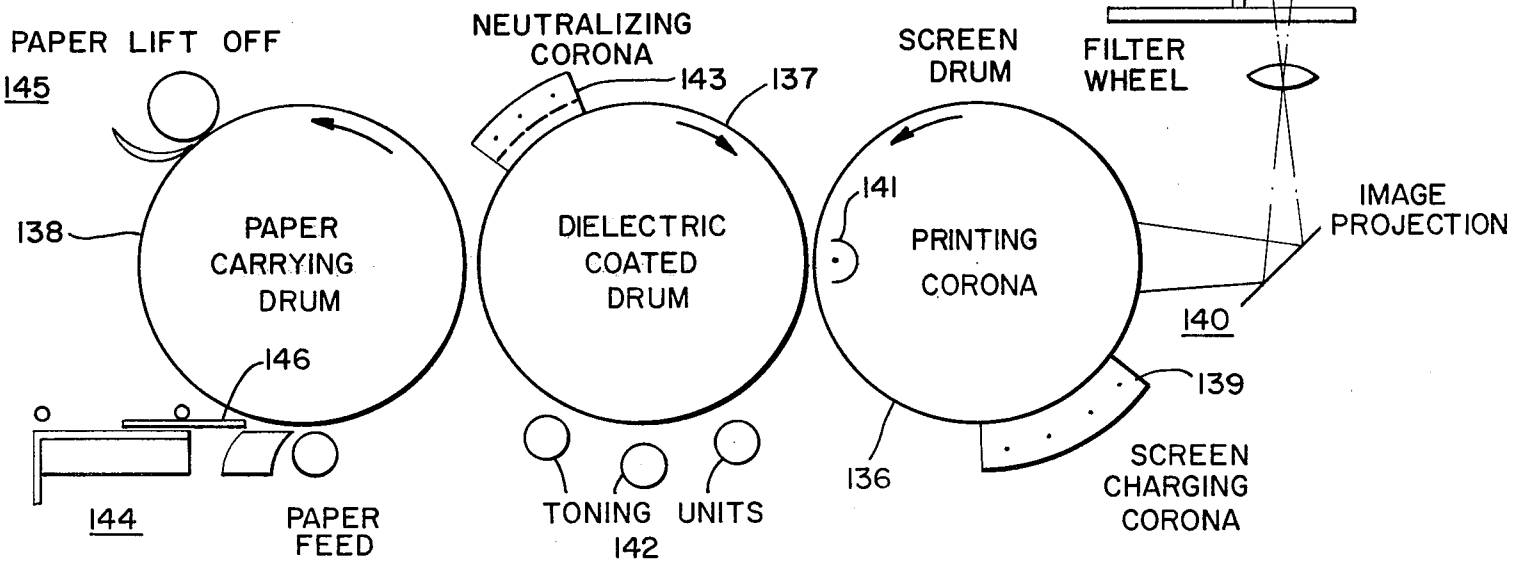
FIG. 13 is a schematic illustration of a multicolor electrostatic rotary drum printing system according to the present invention suited for contact printing on ordinary paper and utilizing an intermediate dielectric coated transfer drum.

An alternate system for employing the contact transfer electrostatic system of Blake U.S. Ser. No. 219,616 for electrostatic reproduction of multicolor images on ordinary paper in accordance with the principles of the present invention is shown in FIG. 13. Apparatus for the system includes a first screen drum 136 mounted for counterclockwise rotation adjacent a dielectric coated transfer drum 137 mounted for clockwise rotation, and a paper carrying drum 138 mounted for counterclockwise rotation adjacent the transfer drum. The rotational axes of these drums lie in a single plane and they rotate in synchronism and register. A screen charging corona 139 is positioned at the outer surface of the screen drum spaced in a clockwise direction a short distance from the multicolor image separation and projection station 140 which is positioned adjacent the outer surface of the screen drum opposite its closest point to the dielectric coated drum. A printing corona 141 is positioned inside the screen drum at its closest point to the dielectric coated drum. Toning units 142 are located at the outer surface of the dielectric coated drum approximately 90° counterclockwise from the position of the transfer drum nearest the screen drum. A neutralizing corona 143 is located adjacent the exterior surface of the dielectric coated transfer drum clockwise a short distance from its nearest point to the paper carrying drum. Paper feed and paper lift-off mechanisms 144 and 146, respectively, are provided adjacent the paper carrying drum, the former approximately 90° clockwise from the point on the paper carrying drum nearest the dielectric coated drum, and the latter spaced a short distance counterclockwise from the same point. Thus according to the present invention the screen drum is charged, imaged and the printing corona actuated to form a corresponding electrostatic latent image on the surface of the dielectric coated transfer drum and that image is exposed to the toning units for development with the appropriately colored toner. Uncoated paper 146 is fed onto a paper carrying drum and the developed image transferred thereto as it passes under pressure between the paper carrying drum and that portion of the dielectric coated drum bearing a developed image. Each drum undergoes a single revolution during development of each single color separation image and the same single sheet of paper is carried by the paper carrying drum throughout those three revolutions. The paper lift-off mechanism is not actuated until all three images are developed and fixed on the paper. Synchronous rotation and registry of the three identical size drums enables the three images to be transferred to the paper in perfect registry.

Figure 15A:
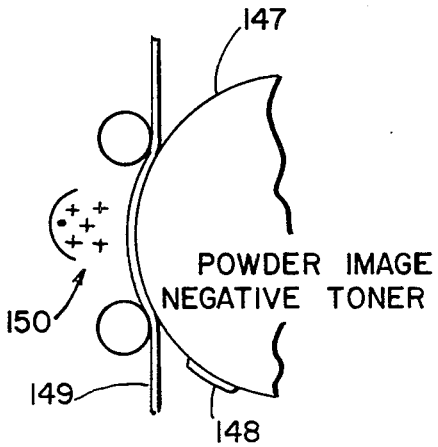
FIGS. 15*a* through 15*c* illustrate three alternative procedures according to the present invention for transferring developed electrostatic images from a dielectric coated transfer drum to ordinary paper.

It is understood that numerous other techniques may be employed for transferring the powder images from a dielectric coated transfer drum to uncoated paper. One such method is shown in FIG. 15*a* wherein the dielectric coated drum 147 carries an image 148 is developed with a dry charged powder. Transfer if effected by applying a sheet of paper 149 to the image bearing surface of the transfer drum and applying an opposite charge 150 to the reverse side of the paper thereby causing the charged image to be attracted to the paper until it may be transported to a heater or other fixing station.

Figure 15B:
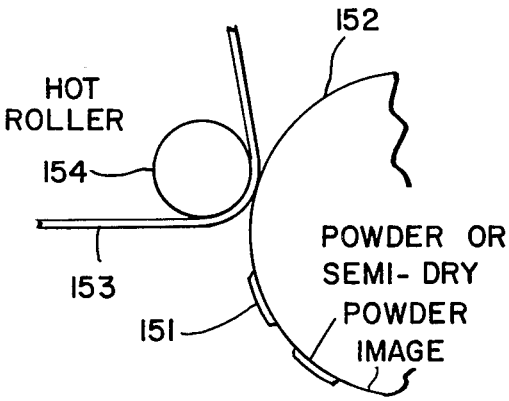

Another transfer technique is illustrated in FIG. 15*b* wherein a developed image 151 of dry or semi-dry powder is carried on the surface of the dielectric coated transfer drum 152. The developed image is overlaid with a sheet of uncoated paper 153 and the back-side of the paper is compressed with a hot roller 152 to transfer and fix the image to the paper.

Figure 15C:
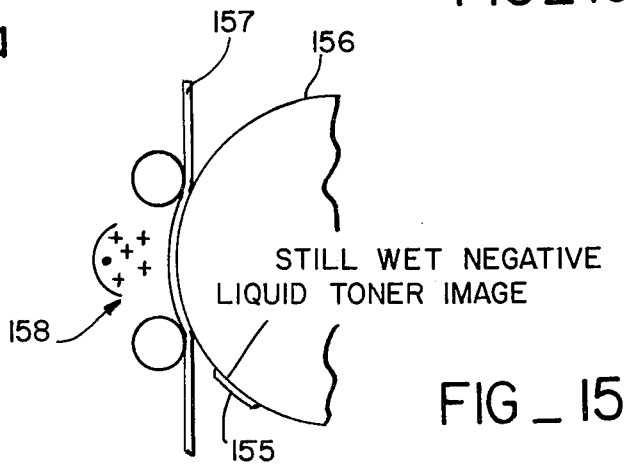

Still another transfer technique is illustrated in FIG. 15*c* wherein a charged liquid image 155 is carried on the dielectric surface of the transfer drum 156 and the image overlaid with a sheet of ordinary paper 57. An opposite charge, such as with ions 158, is applied to the opposite surface of the paper to attract and temporarily hold the liquid image on the paper until it can be transported to a final fixing station, such as a heater.

The transfer systems illustrated in FIGS. 12, 13 and 15*a* through 15*c* have the advantages of greater freedom in the selection of paper and it will be appreciated that while each developed color separation image may be separately transferred to the paper, these systems permit the entire multicolor image to be developed on the transfer drum prior to any transfer to the paper thus providing a simple and automatic mechanical register system and minimizing and simplifying paper handling.

Figure 14:
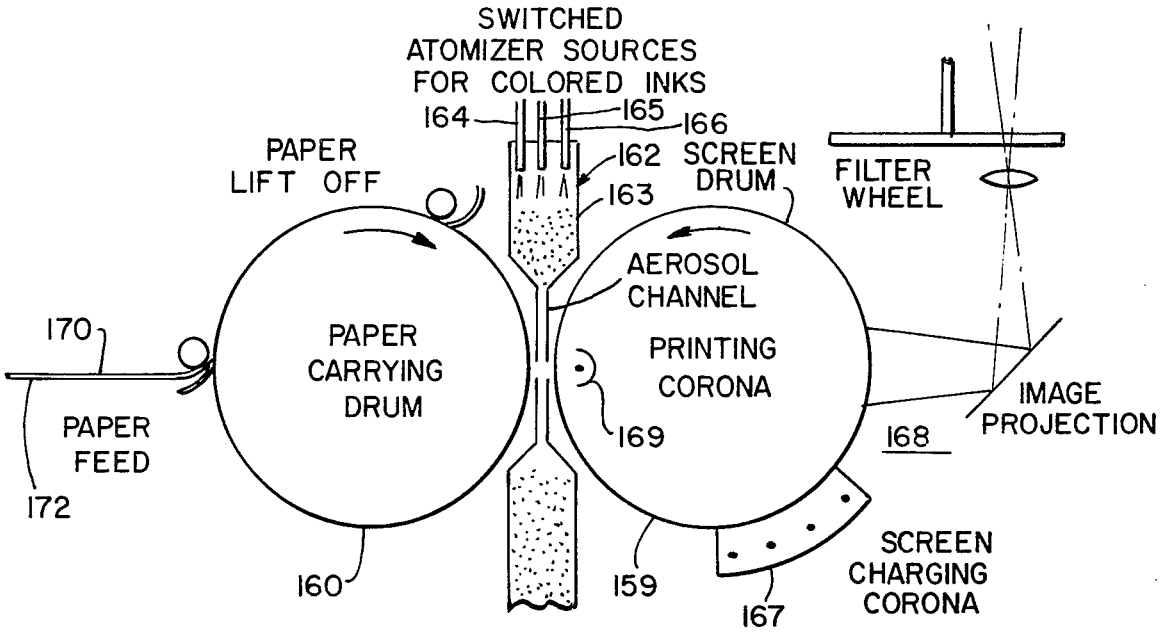
FIG. 14 is a schematic illustration of a multicolor rotary drum printing system according to the present invention for printing on ordinary paper by projecting a modulated ion stream through a cloud or mist of uncharged toner marking particles.

FIG. 14 illustrates a system according to the present invention for a non-contact ion modulated multicolor electrostatic printing system for plain paper wherein the modulated ion stream is projected through a mist of appropriately colored liquid toner particles according to the principles of the invention described in copending, commonly assigned U.S. patent application Ser. No. 101,681 entitled "Toner Feed System For Electrostatic Line Printer" filed Dec. 28, 1970 by Pressman, Frohbach and Blake. The system illustrated in FIG. 14 includes a cylindrical screen and drum 159 and a cylindrical paper carrying drum 160. The drums are of identical diameter mounted for oppositely directed rotation about parallel axes and further includes means 162 for introducing a mist of atomized liquid toner 163 into the space between the two drums. Three separate atomizer nozzles 164, 165 and 166 are provided and switch controlled so that any one of three differently colored toner mists may be employed. A screen charging corona 167 is positioned adjacent the external surface of the screen drum and spaced clockwise a short distance from an imaging station 168. The imaging station is located approximately 180° from the point on the screen drum lying closest to the paper carrying drum. The printing corona 169 is located inside the screen drum at that point and faces the paper carrying drum to provide an ion stream directed through the screen drum, through the toner mist, and onto the paper carrying drum. Paper feed and paper lift-off mechanisms 170 and 171 respectively are provided at convenient locations adjacent the paper carrying drum. Ordinary paper 172 is fed onto the external surface of the paper carrying drum by the paper feed and the paper carried to a position adjacent the screen drum for direct non-contact printing with appropriately colored ion-charged toner particles. In a three color system, the drums undergo a minimum of three revolutions in making a single multicolor reproduction. Each single color separation is printed with a single appropriately colored toner during each revolution. Suitable fixing means (not shown) are provided to fix the developed liquid image on the paper once all three single color images have been developed and then the paper lift-off is actuated to remove the printed multicolor copy from the paper carrying drum.

Since it is one objective of the present invention to provide a system which has a high degree of accuracy in reproducing color tones, color intensities and highlights, the present invention is therefore concerned with achieving a relatively linear characteristic response curve for variations in screen illumination versus variations in ion transmission by the screen. However, the characteristic curves for the preferred screen of the present invention, for example, as shown in FIGS. 4 and 5 are not linear across the control range or spectrum from full blocking to full enhancing so that there is a tendency, for example, for some portions of the illumination scale to reproduce lighter or darker than they should in relation to other portions of the scale. In black and white printing, we refer to this problem as the "gray scale control" problem. We shall continue to use that phrase herein, although it is understood that the problem relates to toner density control in any color and is not limited to black and white printing.

We have solved this problem to a large extent in a satisfactory manner as is shown in co-pending, commonly assigned U.S. patent application entitled "Method and Apparatus for Optimizing Gray Scale Response of a Multilayer Image Forming Screen" by Gardiner and Pressman, filed on or about the same day as the present case. The solution is achieved by sequentially biasing the voltage across the conductive layers of a four layer screen, (e.g. as shown in FIGS. 4*a* through 4*e*) at two or more levels during the finite interval that charged particles are propelled through the screen and onto the medium.

Referring now to the multilayer apertured element or screen, it will be appreciated that the insulative layer may comprise a photoconductor which is merely charged or discharged in accordance with a light pattern, or it may comprise an insulator other than of the photoconductive type which may be electrically charged. Alternatively, if the selected insulator screen has a low dielectric strength, a thin undercoating of a high dielectric strength material, not necessarily photoconductive, is employed between the photoconductive layer and the conductive layer. Similarly, a thin overcoating of high resistivity material may be employed to provide a charged carrier for photoconductors with poor surface resistivity. When employing photoelectric materials that cannot be deposited in heavy layers, the insulating layer may be comprised of any good insulating material which will accept the sensitive material as a thin deposit. Thus, a thin layer photosensitive material may be coated over the screen comprised of an insulative layer and a conductive layer.

Other materials which may be used as the insulator layers are photoemissive material, polyester films, epoxy, photoresists, fused quartz, or combinations thereof. In addition the conductor backing itself may be deposited on the insulator, or a separate insulator layer not taking part directly in the electrostatic process may be used to support both the conductor and insulator layers.

The dielectric coated print receiving medium may comprise paper or other materials, preferably coated with a very thin layer of plastic or other flexible insulative material, such as polystyrene, polyvinyl chloride, cellulose acetate, such thin layer coated paper being commercially available at the present time.

As is evident, all steps of the process involving photoconductors or other photosensitive materials should be carried out in a light-tight environment to avoid illumination of the photoconductor other than by projection of the image thereon.

Projection of the image onto the screen may be accomplished in any suitable manner, such as with transparencies, as shown, or by opaque projection or any one of other well known techniques.

In the claims and specification herein, the terms "ions", "ion stream" or the like are employed. The preferred source of ions is a corona discharge electrode, which is preferably one or more elongated wires or a plurality of discharge point sources. The preferred ions result from ionization of the ambient air, since the ion particles so formed are clean (i.e. do not clog the screen or grid, or contaminate the print receiving medium), require no special delivery system, and have very low mass by comparison to particles of toner marking material. Nevertheless, it will be appreciated that ions from substances other than ambient air may be employed if desired.

Applicants have generally described the invention in connection with a system where an optical image is projected onto a photoconductor, but it will be appreciated that materials other than photoconductors may be employed, provided that those materials exhibit a change in conductivity upon exposure to an image. For example, photoinsulators (materials which are normally conductive but become insulative upon exposure to light) might be employed; or, materials sensitive to heat, in which case the image to which the material is exposed would be a thermal image.

Accordingly, the present invention contemplates that the photoconductor herein may be substituted by any suitable material which charges electrical conductivity in response to radiation, and that the image be transformed into a form of radiation to which that material so responds.

Since further modifications of the invention within the principles herein taught may readily occur to those skilled in the art, it is intended that the invention be limited only by the appended claims.

We claim:

1. In a system for electrostatic multicolor printing, the combination of:

means for separating a multicolor original pattern to be reproduced into a plurality of substantially single color separation patterns;

means for generating a stream of ions including an ion source and an ion accelerating electrode spaced from said ion source;

means for producing ion patterns by modulating the ion stream including a multilayer apertured element positioned between the ion source and the accelerating electrode and having at least a conductive layer and an insulative layer capable of supporting bipolar charge potentials of differing magnitude for establishing electrostatic lines of force within the apertures of the element for controlling passage of ions in accordance with each given single color separation pattern;

means for developing each of said ion patterns with marking material substantially corresponding in color to one of said single color separations;

means for neutralizing undeveloped charges subsequent to development of a single color separation pattern;

and means for supporting said developed ion patterns in registry to provide a multicolor copy of the original multicolor pattern to be reproduced.

2. In a system for electrostatic multicolor printing, the combination of:

means for separating an original multicolor pattern to be reproduced into a plurality of separate color patterns each corresponding to a different substantially single primary color separation of the original;

means for generating a stream of ions including an ion source and an ion accelerating electrode spaced from said ion source;

means interposed in the ion stream for modulating the ion flow comprising a multilayer aperture element positioned between the ion source and the accelerating electrode and having at least a conductive layer and a photoconductive insulative layer capable of supporting charge potentials in differing magnitude and sign for establishing electrostatic lines of force within the apertures of the element for controlling passage of ions in accordance with one of said primary color separation patterns to be reproduced;

means for positioning a print receiving medium between the modulating element and accelerating electrode;

and means for sequentially introducing a cloud of substantially uncharged single color toner marking particles into the space between the modulating element and positioned print receiving medium whereby the modulated ion stream selectively impinges upon and charges colored toner particles in the cloud which are accelerated and deposited on the print receiving medium in sequence and registry in accordance with said primary color separation patterns.

3. In a system of electrostatic multicolor printing, the combination of:

means for separating an original multicolor pattern to be reproduced into a plurality of separate color patterns each corresponding to a different substantially single primary color separation of the original;

means for generating a stream of ions including an ion source and an ion accelerating electrode spaced from said ion source;

means interposed in the ion stream for modulating the ion flow comprising a multilayer apertured element positioned between the ion source and the accelerating electrode and having at least a conductive layer and a photoconductive insulating layer capable of supporting charge potential in differing magnitude and sign for establishing electrostatic lines of force within the apertures of the element for controlling passage of ions in accordance with one of said primary color separation patterns to be reproduced;

means for supporting an insulative print receiving medium in said modulated ion stream;

means for applying charged selectively colored marking material to said print receiving medium to sequentially develop the separate color separation patterns;

and means for neutralizing undeveloped charges on the print receiving medium between sequential development steps in the sequential development of separate color separation patterns.

4. In a system for electrostatic reproduction of a multicolor pattern, the combination of:

a multilayer apertured element having at least a conductive layer and a photoconductive insulator layer;

means for applying a uniform voltage across the photoconductive layer of said element;

means for sequentially projecting at least a first and second optical color separation image of said multicolor pattern onto said photoconductive layer to selectively discharge said photoconductive layer and produce at least first and second undeveloped latent charge images thereon;

means for supporting a print receiving medium adjacent one major surface of said apertured element, said support means being formed of a conductive material and biased to attract printing ions;

means for projecting printing ions through said apertured element onto said print receiving medium to form at least first and second undeveloped latent charge images thereon, each corresponding to said first and second latent charge images on said apertured element;

means for sequentially applying differently colored charged marking materials to the imaged portions of said print receiving medium;

and means for operably positioning said apertured element after formation of said first undeveloped latent charge images on the print receiving medium so that while said marking material is applied to said imaged portions of said print receiving medium said apertured element will have projected thereon the second optical color separation image in registry with the location of the first separation image.

5. The system recited in claim 4 wherein said print receiving medium has a surface capacitance greater than $10^{-12}$ farads per square centimeter.

6. In apparatus for electrostatic multicolor printing, the combination of:

a cylindrical multilayer screen member having at least a screen photoconductive insulator layer overlying a screen conductor layer;

means for driving said screen member in rotation about its axis of symmetry;

means for maintaining said screen conductor layer at a fixed potential;

means for substantially uniformly charging the exposed surface of said photoconductive layer with a single sign of charge;

means for supplying opposite sign charge to said conductive layer to produce substantially uniform electric fields in the apertures of said screen;

means for separating an original multicolor pattern to be reproduced into at least three different substantially single color separation patterns;

means for projecting a single color separation pattern onto the charged photoconductive layer of said cylindrical screen to modify said aperture fields in accordance with said color separation pattern;

means for projecting ions through the apertures of the screen in the screen region where the charge has been modified;

a second cylindrical member mounted for rotation about its axis of symmetry in synchronism and registry with said cylindrical screen;

means for positioning print receiving medium on said second cylindrical member;

means for applying charged marking material to said positioned print receiving medium, said applying means conditioned to apply separately and in sequence each of at least three differently colored marking materials each corresponding in color to the single color separation pattern to be reproduced;

means for neutralizing undeveloped charges on the print receiving medium subsequent to development of a single color separation pattern on the print receiving medium;

and means for fixing said marking materials to said print receiving medium so that when a uniform charge is applied to the photoconductive layer of the screen and one of said single color separation patterns is projected onto said uniformly charged photoconductive layer, the photoconductive layer is selectively discharged and the electrical fringing fields within the screen apertures modified in accordance with said color separation pattern whereupon as said cylindrical multilayer screen member is rotated to a position where its field modified aperture portions are adjacent said second cylindrical member, ions may be projected through said screen onto said print receiving medium carried on the surface of said cylindrical member thus forming an undeveloped latent electrostatic image on the print receiving medium whereupon the second cylindrical member may be rotated further to carry the imaged print receiving medium past the applying means for development by application of a single color marking material substantially corresponding to the single color separation pattern image and then rotated further to carry the developed image past the neutralizing means for neutralizing the undeveloped charges thereon, and whereby said steps may be repeated for at least second and third color separations to produce a multicolor reproduction of the original multicolor pattern.

7. Apparatus as recited in claim 6 wherein said toner applying means are adapted to apply a liquid toner suspension to the print receiving medium and wherein such apparatus further comprises means for removing excess liquid from the print receiving medium subsequent to each single toner color application.

8. Apparatus as recited in claim 6 further comprising means for neutralizing undeveloped charges on the print receiving medium subsequent to development of a single color separation pattern on the print receiving medium.

9. In apparatus for electrostatic multicolor reproducing, the combination of:

a cylindrical multilayer screen member having at least a screen photoconductive layer overlaying a screen conductor layer, said screen member mounted for rotation about its axis of symmetry;

a charge control cylinder mounted for rotation about its axis of symmetry in synchronism and registry with said screen member, said control cylinder positioned with its axis of symmetry parallel to the axis of symmetry of said screen member and with its external surface immediately adjacent the external surface of said screen member, said charge control cylinder having a conductive layer overlaid on its radially outer surface with an electrically insulative layer;

a paper carrying cylinder mounted for rotation about its axis of symmetry in registry with said screen member, said paper carrying cylinder positioned with its axis of symmetry lying parallel to the axis of symmetry of said screen member, and with its external surface immediately adjacent the external surface on said screen member;

means for supplying primary ions to the interior surface of said screen member at its closest point to said paper carrying cylinder;

means for supplying secondary ions to the internal surface of said screen member at its closest point to said charge control cylinder;

means for biasing said conductive layer of said charge control cylinder with a polarity opposite the polarity of said secondary ions;

means for optically projecting a single color separation pattern of a multicolor pattern to be reproduced onto the radially outer surface of said screen member;

means for applying a sheet of print receiving medium to the radially outer surface of said paper carrying cylinder;

and means for selectively applying colored toner marking particles to print receiving medium carried on said paper carrying cylinder.

10. The combination of claim 9 wherein said means for applying color toner marking particles is suited for applying liquid toner marking particles, and further comprising means positioned downstream therefrom for removing excess liquid from the surface of said print receiving medium after application of liquid toner thereto.

11. The combination of claim 9 further comprising means for applying appropriately colored toner marking particles corresponding to a preselected color separation to print receiving medium carried by said paper carrying drum, and means for supplying tertiary ions to said print receiving medium on said paper carrying drum following application of toner marking particles, said tertiary ions being opposite in polarity to said primary ions to that when said primary ions supply is actuated to apply an electrostatic latent image to the print receiving medium on said paper carrying drum and said imaged print receiving medium is subsequently subjected to toning, said tertiary ions are then employed to neutralize undeveloped portions of said image.

12. In apparatus for electrostatic multicolor reproducing, the combination of:

means for carrying sheets of paper along the path from a paper feed station to a paper outlet station and including an endless track with spaced support members;

means positioned intermediate said paper feed and outlet stations for forming an electrostatic latent image on the surface of paper on said carrying means and including means for supplying ions to paper carried along said path, a multilayer screen having at least a screen photoconductive insulator layer overlaying a screen conductor layer, said screen positioned between said ion supply means and said path, and means for projecting an optical color separation of a multicolor pattern to be reproduced onto said screen, said electrostatic latent image corresponding to a single color separation of a multicolor pattern to be reproduced;

said optical image projecting means positioned on the opposite side of said endless track from said screen, so that said screen may be imaged between sequential printing operations by projecting said image through the spaces between said spaced support members onto said screen;

and means positioned intermediate said imaging means and said paper outlet for developing said electrostatic latent image with appropriately colored marking particles so that a plurality of sheets of paper may be fed onto the paper carrying means and each printed with a single color separation of the multicolored pattern to be reproduced and then removed from the paper carrying means whereupon the same sheets of paper may then be returned to the paper feed station and the operation repeated for second and third color separations to provide a printed copy of the multicolor pattern to be reproduced.

13. The combination of claim 12 wherein said endless tract is comprised of means for applying a vacuum to the side of said paper support member opposite the paper support surface, said vacuum supply means extending along said path between said paper feed station and said paper outlet station, said paper support surface facing downwardly so that when paper is placed against said paper support surface it is held thereon by said vacuum supply means for the entire traverse of said path, said paper tending to fall off said paper support once it has travelled along said path to a position beyond the downstream limit of said vacuum supply means.

14. In apparatus for electrostatic multicolor reproducing, the combination of a cylindrical multilayer screen having at least a screen photoconductive insulator layer overlaying a screen conductor layer mounted for rotation about its axis of symmetry;

a paper carrying cylinder mounted for rotation about its axis of symmetry in synchronism and registry with said cylindrical screen, said paper carrying and screen cylinders positioned immediately adjacent one another with their said axes parallel;

means for substantially uniformly charging the photoconductive layer of said screen cylinder;

means for projecting an optical image corresponding to a single color separation of a multicolor pattern to be reproduced onto the photoconductive surface of said screen cylinder to selectively discharge said screen in accordance with said color separation;

means for supplying a stream of ions to the inner surface of said screen cylinder at a position immediately adjacent the closest point of said screen cylinder to said paper carrying cylinder;

means for generating an electrical field between said ion source and said paper carrying cylinder to accelerate said ions from their source to the paper carrying cylinder via said screen;

and means for sequentially introducing a cloud of substantially uncharged toner marking particles corresponding in color to a single color separation into the space between said cylinders, so that when said cylinder screen has been uniformly charged and thereafter selectively discharged to produce thereon an electrostatic latent image corresponding to a single color separation of the multicolor pattern to be reproduced, the electrostatic image bearing portion of said cylinder screen may be rotated to a position adjacent said ion supply means which may be actuated to supply ions to the apertures of said screen, said ions being accelerated through said screen by said electrical field generating means resulting in a modulated ion stream in the space between said cylinders, said stream having a cross-sectional density corresponding to single color separation, and single color uncharged toner marking particles may be introduced into the modulated ion stream in the space between said cylinders, uncharged particles of said cloud which impinge upon the ions in said stream becoming charged and accelerated by said electrical field generating means onto paper carried on the surface of said paper carrying cylinder.

15. The combination of claim 14 wherein said toner cloud introducing means comprises a switched atomizer source adapted to atomize at least three different colored toner marking particles with switching mechanisms suited to sequentially regulate the introduction of said toner into the space between said cylinders.

16. In apparatus for electrostatic multicolor reproducing, the combination of:

a cylindrical multilayer screen having at least a screen photoconductive insulator layer overlaying a screen conductor layer, said screen mounted for rotation about its axis for symmetry;

a cylindrical dielectric coated transfer member mounted for rotation about its axis of symmetry, said member located immediately adjacent said cylindrical screen with its axis parallel thereto;

means for uniformly charging the photoconductive layer of said screen;

means for optically projecting a single color separation of a multicolor pattern to be reproduced onto said photoconductive layer to selectively discharge said photoconductive layer and form an electrostatic latent image on said screen in accordance with single color separation;

means for supplying a stream of ions to the radially inner surface of said cylindrical screen, said supply means located adjacent the closest point of said screen to said transfer member;

means for generating an electrical field between said ion supply means and said transfer member;

so that when said screen is uniformly charged and thereafter selectively discharged in accordance with a single color separation of a multicolored pattern to be reproduced by said optical projection means, the imaged portion of said cylindrical screen may be rotated to a position adjacent said ion supply means which may be then activated to provide a stream of ions to the apertures of said screen which may be accelerated through said screen onto the surface of said dielectric coated transfer member by said electrical field to impinge upon the dielectric surface of said transfer member and be held there in said color separation pattern by said field;

means for selectively applying colored marking material to said transfer member so that the electrostatic latent image formed on said transfer member may be temporarily developed directly on the dielectric surface thereof;

means for rotating said screen and transfer member cylinders in synchronism about their respective axis so that while the colored marking material is being applied to said transfer member to develop the electrostatic image said uniformly charging means can be activated to commence uniform charging of the photoconductive layer of the screen;

and means for applying print receiving medium to the transfer member to overlay the developed image thereon so that the image may be transferred from said transfer member to said print receiving medium.

17. The combination of claim 16 further comprising means for removing excess fluid from the developed image on the surface of said transfer member.

18. The combination of claim 16 wherein means for supplying neutralizing ions to the developed image on said transfer drum are located adjacent the surface of said transfer member so that undeveloped portions of said electrostatic latent image formed on said transfer member remaining after development may be neutralized prior to formation of subsequent electrostatic latent images corresponding to other color separations of the same multicolor pattern to be reproduced.

19. In apparatus for electrostatic multicolor reproducing, the combination of:

a multilayer screen cylinder having at least a screen photoconductive insulator layer overlaying a screen conductor layer, said screen cylinder mounted for rotation about its axis of symmetry;

a dielectric coated transfer cylinder mounted for rotation about its axis of symmetry in synchronism and registry with said cylindrical screen, said transfer cylinder positioned immediately adjacent said screen cylinder with its axis parallel thereto;

a paper carrying cylinder mounted for rotation about its axis of symmetry in synchronism and registry with said transfer cylinder, said paper carrying cylinder positioned immediately adjacent said transfer cylinder with its axis parallel thereto;

means for substantially uniformly charging the photoconductive layer of said screen cylinder;

means for projecting an optical image onto said photoconductive layer to selectively discharge said photoconductive layer in accordance with a color separation of a multicolor pattern to be reproduced to form on said screen cylinder an electrostatic latent image corresponding to said color separation;

means for supplying a stream of ions to the radially inner surface of said screen, said ion supply means located adjacent the closest point of said screen cylinder to said transfer cylinder;

means for generating an electrical field between said ion source and said transfer cylinder to accelerate said ions from said source to the transfer cylinder through the imaged portion of said stream cylinder to modulate the cross-sectional density of said ion stream in accordance with said color separation;

means for applying colored marking material to the surface of said transfer cylinder said means conditioned to apply selected colors at selected times, so that appropriately colored material may be applied to a single color separation image formed on said transfer cylinder;

means for rotating said transfer cylinder past said applying means while said screen cylinder is rotated past said optical image projecting means so that formation of the color separated image on said transfer cylinder and formation of the electrostatic image corresponding to a subsequent color separation on the screen cylinder occurs within one revolution of each respective cylinder;

and means for feeding a sheet of print receiving medium onto the surface of said paper carrying cylinder so that a single color separation electrostatic latent image may be formed and developed on said transfer cylinder during each revolution of said transfer cylinder and then a sheet of print receiving medium applied to the paper carrying cylinder once all color separations have been developed in registry on the surface of said transfer cylinder whereupon a complete developed multicolor image may be transferred from said transfer cylinder to said paper in a single step.

20. The combination of claim 19 further comprising means for supplying neutralizing ions to the surface of said transfer cylinder so that when a developed image on said transfer cylinder is rotated into a position adjacent said neutralizing ion supply means and neutralizing ions supplied to said image, undeveloped portions of said developed image will be neutralized prior to formation of subsequent electrostatic latent images in registry therewith.

21. In apparatus for electrostatic multicolor reproductions, the combination of a multilayer screen having at least a screen insulator layer overlaying screen conductor layer;

a dielectric surface moveable between a first position adjacent to and facing said screen and a second position remote from said screen;

means for imposing an electrostatic latent image on said screen in accordance with a single color separation image of a multicolor pattern to be reproduced;

means for supplying a stream of ions through said screen to said dielectric surface whereby said stream is modulated in accordance with the image on said screen to form an electrostatic latent color separation image on said dielectric surface while at said first position;

means for moving said dielectric surface to said second position;

means for developing said electrostatic latent color separation image on said dielectric surface at said second position; and means for preparing screen to receive the electrostatic latent image, said preparing means operable on said screen while said dielectric surface is at said second position;

so that when multiple color separations of a multicolor separation image are developed in sequence on the dielectric surface, such as upon dielectric paper or on a dielectric transfer surface, reproduction of one separation image may be commenced before reproduction of a prior color separation image has been completed in printing operations carried out with a single screen.

* * * * *

UNITED STATES PATENT OFFICE

CERTIFICATE OF CORRECTION

Patent No. 4,006,983 Dated February 8, 1977

Inventor(s) Gerald L. Pressman etal

It is certified that error appears in the above-identified patent and that said Letters Patent are hereby corrected as shown below:

On the cover sheet Item (75)

"Odenphal-Hahnenberg, both of Calif." should read

-- Menlo Park, both of Calif. --.

Signed and Sealed this

Thirty-first Day of May 1977

[SEAL]

*Attest:*

RUTH C. MASON
*Attesting Officer*

C. MARSHALL DANN
*Commissioner of Patents and Trademarks*